US011158952B1

(12) United States Patent
Azad et al.

(10) Patent No.: US 11,158,952 B1
(45) Date of Patent: Oct. 26, 2021

(54) LOW PROFILE OMNIDIRECTIONAL ANTENNA

(71) Applicant: Amazon Technologies, Inc., Seattle, WA (US)

(72) Inventors: Mohammed Ziaul Azad, Pleasanton, CA (US); Chen Chen, Sunnyvale, CA (US); Amit Gaikwad, Saratoga, CA (US); In Chul Hyun, Saratoga, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/787,907

(22) Filed: Feb. 11, 2020

(51) Int. Cl.

| | |
|---|---|
| ***H01Q 13/12*** | (2006.01) |
| ***H01Q 5/30*** | (2015.01) |
| ***H01Q 1/24*** | (2006.01) |
| ***H01Q 21/20*** | (2006.01) |

(52) U.S. Cl.
CPC ..... *H01Q 13/12* (2013.01); *H01Q 1/243* (2013.01); *H01Q 5/30* (2015.01); *H01Q 21/205* (2013.01)

(58) Field of Classification Search
CPC ..... H01Q 13/10; H01Q 13/12; H01Q 1/243; H01Q 5/30; H01Q 21/205
See application file for complete search history.

(56) References Cited

U.S. PATENT DOCUMENTS

| | | | | |
|---|---|---|---|---|
| 3,293,645 A * | 12/1966 | Farley | H01Q 1/281 343/708 |
| 5,917,454 A * | 6/1999 | Hill | H01Q 13/12 343/769 |
| 2004/0189536 A1* | 9/2004 | Ryou | H01Q 1/242 343/702 |
| 2018/0062769 A1* | 3/2018 | Kim | H01Q 13/10 |

* cited by examiner

*Primary Examiner* — Hoang V Nguyen
(74) *Attorney, Agent, or Firm* — Lowenstein Sandler LLP

(57) ABSTRACT

Technologies directed to cylindrical antenna structures. One metallic cylindrical antenna structure includes a first surface, a second surface, and a side wall with a first height. The cylindrical antenna structure can have a low profile with the first height being less than 20 millimeters (mm). The side wall includes first and second slots, the first being centered at a first point on the side wall at a second height and oriented longitudinally along an azimuthal direction of the cylindrical antenna structure and the second being centered at a second point on the side wall at the second height and oriented longitudinally along the azimuthal direction. A feed structure is located on the center axis and is physically separated from the first and second surfaces. The cylindrical antenna structure radiates electromagnetic energy in an omnidirectional radiation pattern, responsive to a radio frequency (RF) signal being applied to the feed structure.

19 Claims, 22 Drawing Sheets

Current Distribution Radiating Slot

Low X H-Field Region

Low Y H-Field Region

LOW PROFILE OMNIDIRECTIONAL ANTENNA

BACKGROUND

A large and growing population of users is enjoying entertainment through the consumption of digital media items, such as music, movies, images, electronic books, and so on. The users employ various electronic devices to consume such media items. Among these electronic devices (referred to herein as endpoint devices, user devices, clients, client devices, or user equipment) are electronic book readers, cellular telephones, Personal Digital Assistants (PDAs), portable media players, tablet computers, netbooks, laptops, and the like. These electronic devices wirelessly communicate with a communications infrastructure to enable the consumption of the digital media items. In order to communicate with other devices wirelessly, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
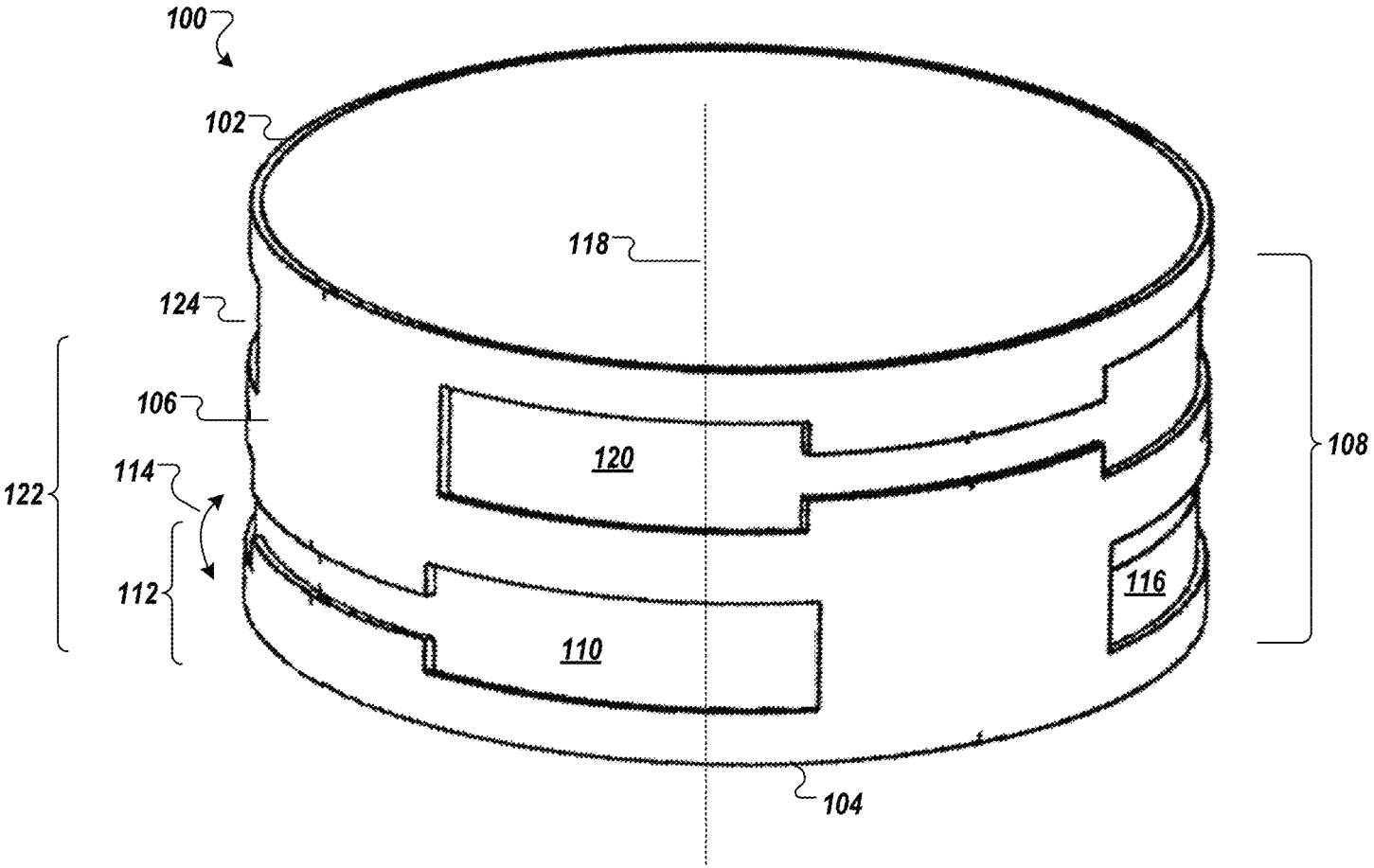
FIG. 1 is a perspective view of a low-profile cylindrical antenna structure that generates an omnidirectional radiation pattern according to one embodiment.

Technologies directed to a cylindrical antenna structure. Directional antennas have very good coverage (also referred to as gain) in a particular direction due to their directive nature, whereas non-directional antennas, such as omnidirectional antennas, low gain bi-directional, low gain spherical radiating antennas, have good coverage in most directions. Directional antennas have some advantages in some applications, such as point-to-point communication. Despite some advantages, directional antennas have poor coverage (poor gain) in the other directions. In some applications, such as drones or robots that use wireless local area network (WLAN), personal area network (PAN), and/or cellular radio technologies, non-directional such as omnidirectional antennas, low gain bi-directional, low gain spherical radiating antennas provide the benefit of good coverage in all directions. Also, these antennas have the advantage of using higher power levels for better coverage without violating Equivalent Isotropically Radiated Power (EIRP) requirements or Specific Absorption Rate (SAR) regulations where directional antennas is power limited to meet EIRP or SAR regulations.

Conventional omnidirectional antennas, such as dipoles need 0.5λ (half wave length where λ represents a wavelength of a corresponding frequency), which can be difficult to implement in some wireless consumer devices because dipoles need a Balun for a balanced antenna system and the length of the dipoles. For example, at 2.4 GHz a half wavelength is approximately 62 millimeters (mm), resulting in large and bulky antennas. Drones, walkie-talkies, routers, indoor antenna towners (e.g., Wi-Fi®/cellular towers), robots, or the like typically include one or more external mounted antennas to accommodate the 62 mm in length for the omnidirectional dipole antenna. Similarly, conventional slot antennas can have omnidirectional radiation patterns but also need 0.5λ length and at least 0.25λ height from a ground plane. Similarly, the antennas needs to be in noise interference free system which means it is free of noise interferences from other components on a circuit board. For example, a processor, a memory, or a bus that is operating at a high frequency can create electromagnetic interference (EMI) (also referred to as radio frequency interference (RFI)). It should be noted that 0.5λ is also represented as 0.5 times a wavelength of the operating frequency.

Aspects of the present disclosure overcome the deficiencies of conventional antennas by providing a very low profile as compared to the 0.5λ dipoles or 0.5λ slot antennas for omnidirectional nature and with 0.25λ height from a ground plane if it needs to operate with ground plane. Aspects of the present disclosure can provide a profile of 0.07λ-0.1λ of height. When operating at 2.4 GHz, a height of the cylindrical antenna structure can be less than 13 mm, such as in a range between approximately 8.7 mm in height (for 0.07λ) to approximately 12.44 mm in height (0.1λ). Aspects of the present disclosure overcome the deficiencies of conventional antennas by providing an antenna structure that can operate in free space (FS) and at any height above a ground plane. Aspects of the present disclosure overcome the deficiencies of conventional antennas by providing an antenna structure that can provide low gain non-directional coverage to cover more area with low directivity. Aspects of the present disclosure overcome the deficiencies of conventional antennas by providing an antenna structure that can provide an advantage of using higher power with EIRP/SAR regulations as an advantage over any conventional directional antenna with respect to the EIRP/SAR. Aspects of the present disclosure overcome the deficiencies of conventional antennas by providing a noise immune antenna structure that can help place noise source components to develop very low noise RF device. The noise immune antenna structure can be placed on a circuit board and noise source components (also referred to as noise aggressors), such as a processor, a memory device, or a bus that operates at high clock speeds, can be placed in regions of the circuit board where the magnetic fields (H fields) are low. The H fields are based on dominant x or y components of the noise source component. By placing the noise source component where the H fields are low, the cylindrical antenna structure becomes opaque to the noise source component—becoming noise immune. The antenna structure can have no desense or very low desense with the noise source component. Aspects of the present disclosure can allow removal of EMI shielding mechanisms (e.g., shield CAN) for these noise source components, resulting in a significant savings in cost. One metallic cylindrical antenna structure includes a first surface, a second surface, and a side wall with a first height. The cylindrical antenna structure can have a low profile with the first height being less than 20 mm (e.g., 12.5 mm for 0.1λ). The side wall includes first and second slots, the first being centered at a first point on the side wall at a second height and oriented longitudinally along an azimuthal direction of the cylindrical antenna structure and the second being centered at a second point on the side wall at the second height and oriented longitudinally along the azimuthal direction. A slot is an elongated opening in the metal of the metallic cylindrical antenna structure. A feed structure is located on the center axis and is physically separated from the first and second surfaces. The cylindrical antenna structure radiates electromagnetic energy in non-directional fashion such as omnidirectional, low gain bi-directional, low gain spherical pattern, responsive to a radio frequency (RF) signal being applied to the feed structure. The feed structure can be considered to be a coupled feed structure that feeds each slot of the cylindrical antenna structure.

FIG. 1 is a perspective view of a low-profile cylindrical antenna structure 100 that generates an omnidirectional radiation pattern according to one embodiment. The cylindrical antenna structure 100 can be part of a wireless device having one or more radios to communicate data to another wireless device. The cylindrical antenna structure 100 is made up of metal and can be at least partially filled with dielectric material. The cylindrical antenna structure 100 includes a top surface 102, a bottom surface 104, and a side wall 106 with a first height 108 between the top surface 102 and the bottom surface 104. The first height 108 is what makes the cylindrical antenna structure 100 considered low profile. The first height 108 is much less than half wavelength (λ) of an operating frequency range of the cylindrical antenna structure 100. As described above, conventional dipole and conventional slot antennas need half wavelength in effective length. In one embodiment, the first height 108 is equal to or less than 0.1λ.

As illustrated in FIG. 1, the top surface 102, the bottom surface 104, and the side wall 106 form a right circular, hollow cylinder. Alternatively, the cylindrical antenna structure 100 can have an oblique hollow cylinder. In other embodiments, the cylindrical antenna structure 100 can be other shapes, such as shapes with flat surfaces, curved surfaces, edges, or the like.

As illustrated in FIG. 1, the side wall 106 includes a first slot 110 in the metal. The first slot 110 is centered at a first point on the side wall 106 at a second height 112 from the bottom surface 104 and is oriented longitudinally along an azimuthal direction 114 of the cylindrical antenna structure 100. The side wall 106 includes a second slot 116 that is centered at a second point on the side wall 106 at the second height 112 and is oriented longitudinally along the azimuthal direction, the second point being diametrically opposite the first point. That is, the first point is opposite the second point about a center axis 118 of the cylindrical antenna structure 100. The side wall 106 includes a third slot 120 that is centered at a third point on the side wall 106 at a third height 122 from the bottom surface 104 and is oriented longitudinally along the azimuthal direction. The third height 122 is greater than the second height 112. The side wall 106 includes a fourth slot 124 that is centered at a fourth point on the side wall at the third height and is oriented longitudinally along the azimuthal direction, the fourth point being diametrically opposite the third point. In the depicted embodiment, the first point is equidistant from the third point and the fourth point and the second point is equidistant from the third point and the fourth point. In other embodiments, the points of the elongated slots are opposite one another in a first plane and the slots in a second plane are rotated by an angle from the slots in the first plane. Alternatively, the elongated slots can be asymmetrical relative to one another or partially asymmetrical relative to one another.

In the illustrated embodiment, the slots 110, 116, 120, 124 are identical in shape and size. Alternatively, different shapes can be used than those illustrated. In some embodiments, the slots are rectangular. In other embodiments, the slots can include sections of the rectangle that achieve a longer effective length of the slot opening, such as illustrated in FIG. 1. Additional details regarding the shape of the slots are described below with respect to FIGS. 3A-3D.

Figure 2:
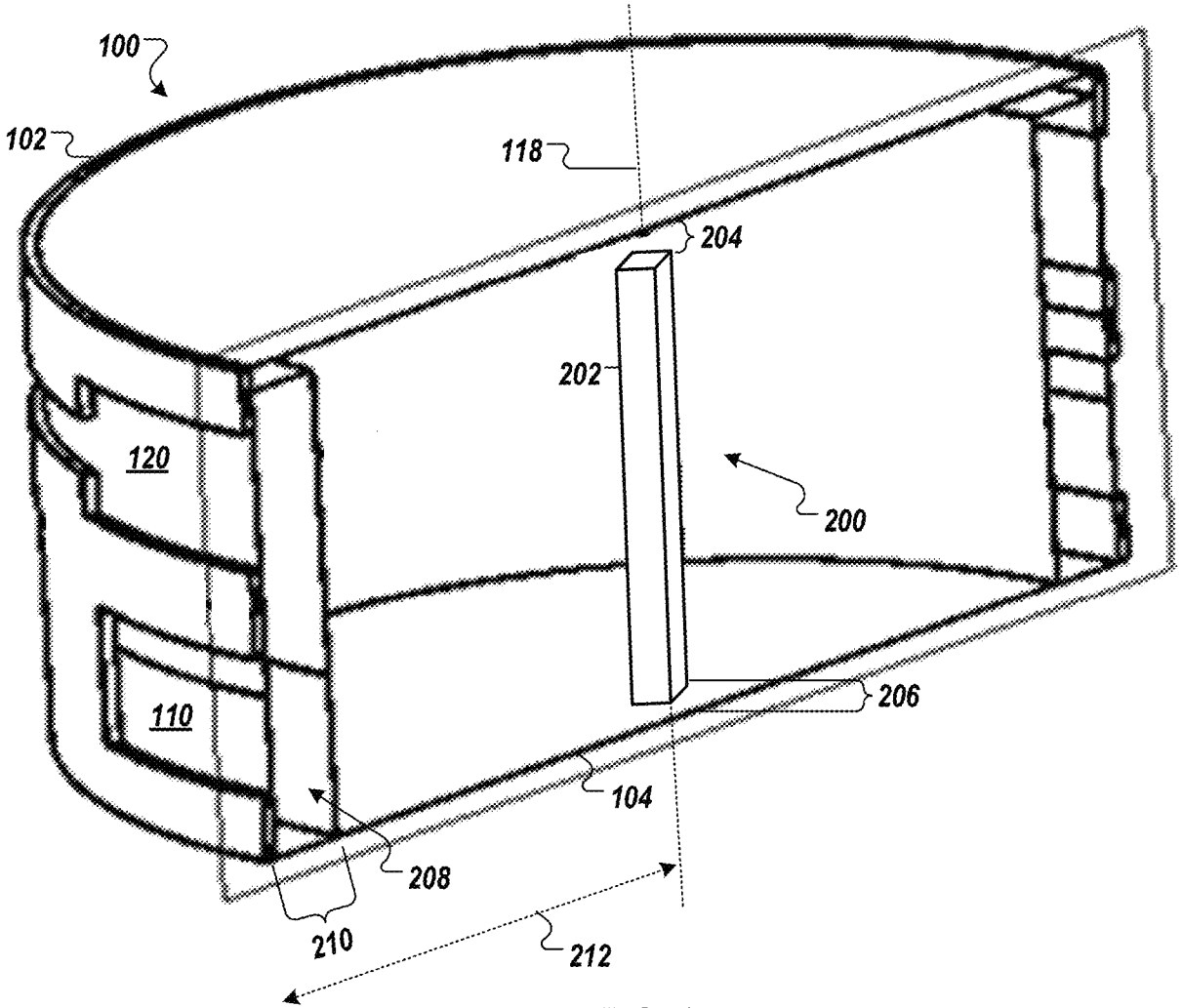
FIG. 2 is a cross-sectional view of the low-profile cylindrical antenna structure of FIG. 1.

As illustrated in FIG. 2, a coupled feed structure 200 is used to feed the cylindrical antenna structure 100. A radio of the wireless device is coupled to the coupled feed structure and applies or intercepts a radio frequency (RF) signal to the coupled feed structure 200 to radiate electromagnetic energy in the omnidirectional radiation pattern. That is, the cylindrical antenna structure 100 is configured to radiate electromagnetic energy in the omnidirectional radiation pattern, responsive to the RF signal being applied to the coupled feed structure 200. Alternatively, the radio can receive an RF signal detected by the cylindrical antenna structure 100.

FIG. 2 is a cross-sectional view of the low-profile cylindrical antenna structure 100 of FIG. 1. The cylindrical antenna structure 100 includes a coupled feed structure 200 that can be coupled to a radio of the wireless device. The coupled feed structure 200 having a metal member 202 located on the center axis that is physically separated from the top surface 102 and the bottom surface 104. That is, there is a first gap 204 between the metal member 202 and the top surface 102 and a second gap 206 between the metal member 202 and the bottom surface 104 and can feed the antenna from any side.

In some embodiments, an antenna carrier can be disposed within the cylindrical antenna structure 100. As illustrated in FIG. 2, a second cylindrical structure 208 of dielectric material is located within the cylindrical antenna structure 100. The second cylindrical structure 208 is an antenna carrier of dielectric material. The second cylindrical structure 208 can reduce the overall volume of the antenna to have a smaller form factor, as compared to an antenna structure without the antenna carrier of dielectric material. The second cylindrical structure 208 has a center axis that is the same as the center axis 118 of the cylindrical antenna structure 100. An outer surface of the second cylindrical structure 208 is adjacent to an inner surface of the cylindrical antenna structure 100. The second cylindrical structure 208 has a thickness 210 that is less than a radius 212 of the cylindrical antenna structure 100.

Figure 3B:
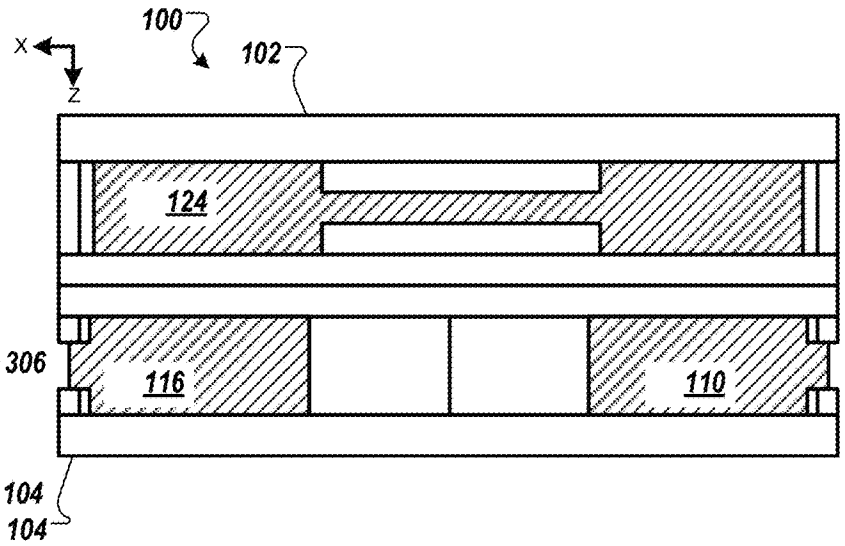
FIG. 3B is a left-side view of the low-profile cylindrical antenna structure of FIG. 1.
Figure 3A:
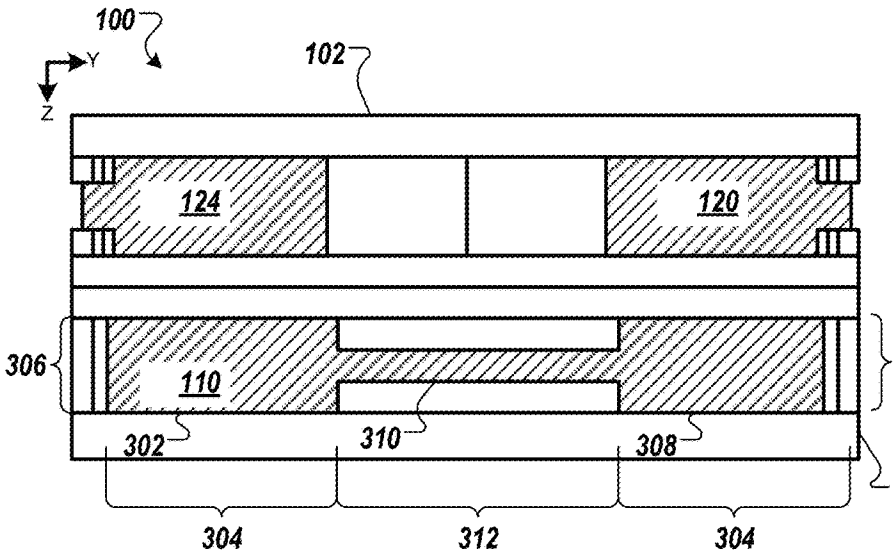
FIG. 3A is a front view of the low-profile cylindrical antenna structure of FIG. 1.

FIG. 3A is a front view of the low-profile cylindrical antenna structure 100 of FIG. 1. The front view shows the first slot 110 in the metal as including a first rectangular portion 302 with a second length 304 in the azimuthal direction and a first width 306 perpendicular to the azimuthal direction; a second rectangular portion 308 with the second length 304 along in the azimuthal direction and the first width 306 perpendicular to the azimuthal direction; and a third rectangular portion 310 with a third length 312 in the azimuthal direction and a second width perpendicular to the azimuthal direction, the second width being less than the first width 306. The third rectangular portion 310 is located between the first rectangular portion 302 and the second rectangular portion 308 in the azimuthal direction. The front view also shows portions of the third slot 120 and the fourth slot 124.

FIG. 3B is a left-side view of the low-profile cylindrical antenna structure of FIG. 1. The left-side view shows the fourth slot 124 in the metal as including a fourth rectangular portion with the second length in the azimuthal direction and the first width perpendicular to the azimuthal direction; a fifth rectangular portion with the second length along in the azimuthal direction and the first width perpendicular to the azimuthal direction; and a sixth rectangular portion with the third length in the azimuthal direction and the second width perpendicular to the azimuthal direction, the second width being less than the first width. The sixth rectangular portion is located between the fourth rectangular portion and the fifth rectangular portion in the azimuthal direction. The left-side view also shows portions of the first slot 110 and the second slot 116.

Figure 3D:
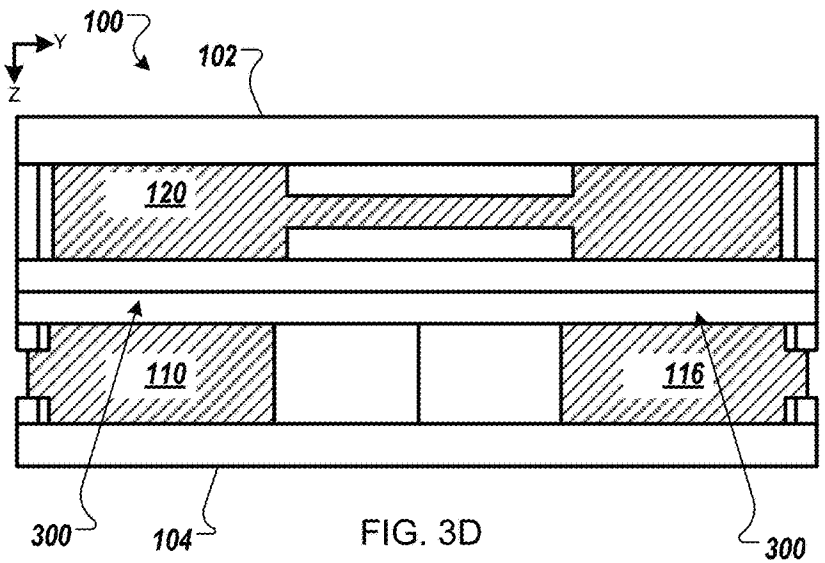
FIG. 3D is a right-side view of the low-profile cylindrical antenna structure of FIG. 1.
Figure 3C:
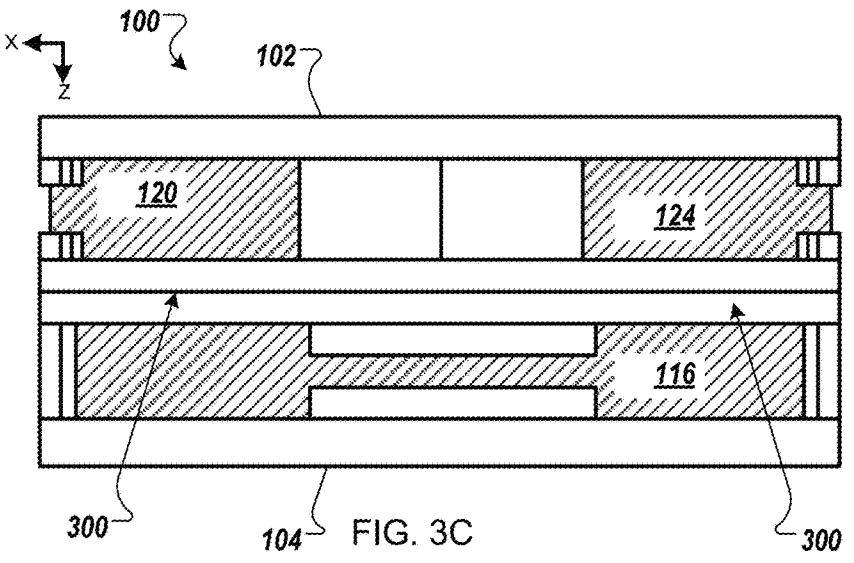
FIG. 3C is a back view of the low-profile cylindrical antenna structure of FIG. 1.

FIG. 3C is a back view of the low-profile cylindrical antenna structure of FIG. 1. The back view shows the second slot 116 in the metal as including a seventh rectangular portion with the second length in the azimuthal direction and the first width perpendicular to the azimuthal direction; an eighth rectangular portion with the second length along in the azimuthal direction and the first width perpendicular to the azimuthal direction; and a ninth rectangular portion with the third length in the azimuthal direction and the second width perpendicular to the azimuthal direction, the second width being less than the first width. The ninth rectangular portion is located between the seventh rectangular portion and the eighth rectangular portion in the azimuthal direction. The back view also shows portions of the third slot 120 and the fourth slot 124.

FIG. 3D is a right-side view of the low-profile cylindrical antenna structure of FIG. 1. The right-side view shows the third slot 120 in the metal as including a tenth rectangular portion with the second length in the azimuthal direction and the first width perpendicular to the azimuthal direction; an eleventh rectangular portion with the second length along in the azimuthal direction and the first width perpendicular to the azimuthal direction; and a twelfth rectangular portion with the third length in the azimuthal direction and the second width perpendicular to the azimuthal direction, the second width being less than the first width. The twelfth rectangular portion is located between the tenth rectangular portion and the eleventh rectangular portion in the azimuthal direction. The right-side view also shows portions of the first slot 110 and the second slot 116.

FIGS. 3A-3D show the cylindrical antenna structure with four slots on the side wall. All of the slots are fed by a coupled feed structure. Each slot is excited by the coupled feed at the same time and at the same frequency.

Figure 4A:
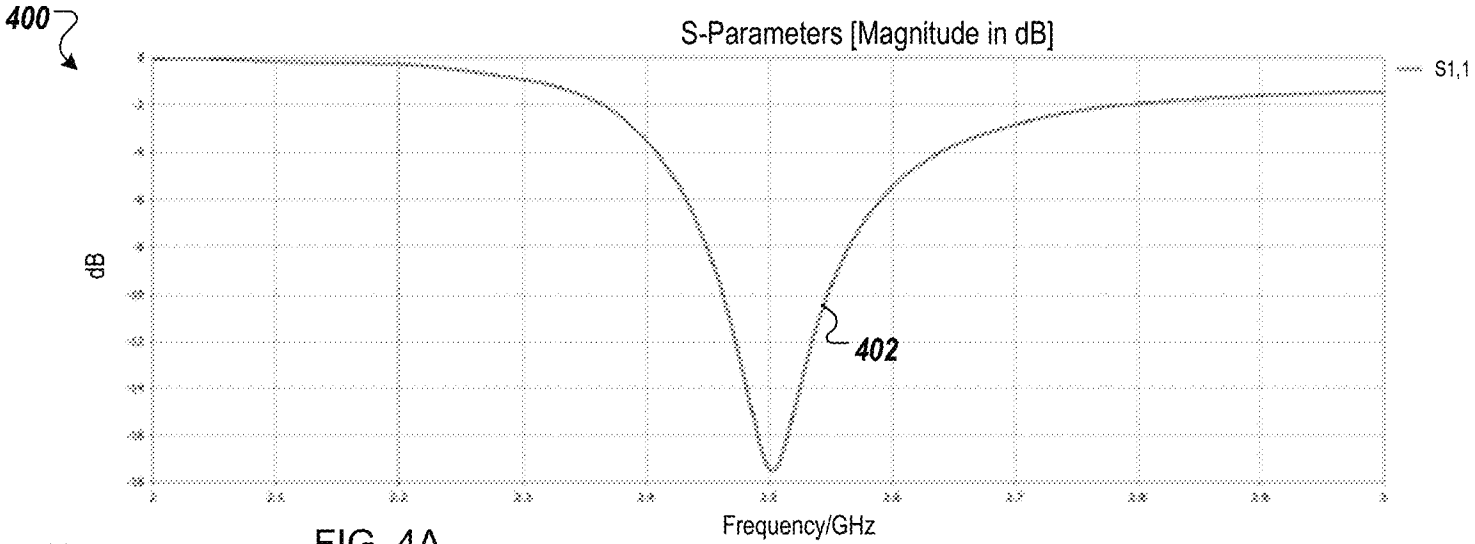
FIG. 4A is a graph of s-parameters of the low-profile cylindrical antenna structure of FIG. 1.

FIG. 4A is a graph 400 of S-parameters of the low-profile cylindrical antenna structure 100 of FIG. 1. The S-parameters indicates an amount of power reflected at antennas coupled to the ports of the radios of a wireless device. For example, $S_{11}$ 402 represents an amount of power reflected by the cylindrical antenna structure 100 coupled to the port of the radio. The graph 400 may indicate that the $S_{11}$ 402 is below approximately −6 dB with a bandwidth of more than 150 MHz which can easily be translated to any desired frequency, such as 2.4-2.485 GHz (e.g., Wi-Fi® band). A port can be loosely defined as any place where we can deliver voltage and current. So, if we have a communication system with two radios (radio 1 and radio 2), then the radio terminals (which deliver power to the two antennas) would be the two ports. $S_{11}$ then would be the reflected power port 1 is trying to deliver to antenna 1. S22 would be the reflected power radio 2 is attempting to deliver to antenna 2. And $S_{12}$ is the power from port 2 that is delivered through antenna 1 to port 1. Note that in general S-parameters are a function of frequency (i.e. vary with frequency). The graph 400 indicates that the cylindrical antenna structure 100 has good bandwidth.

Figure 4B:
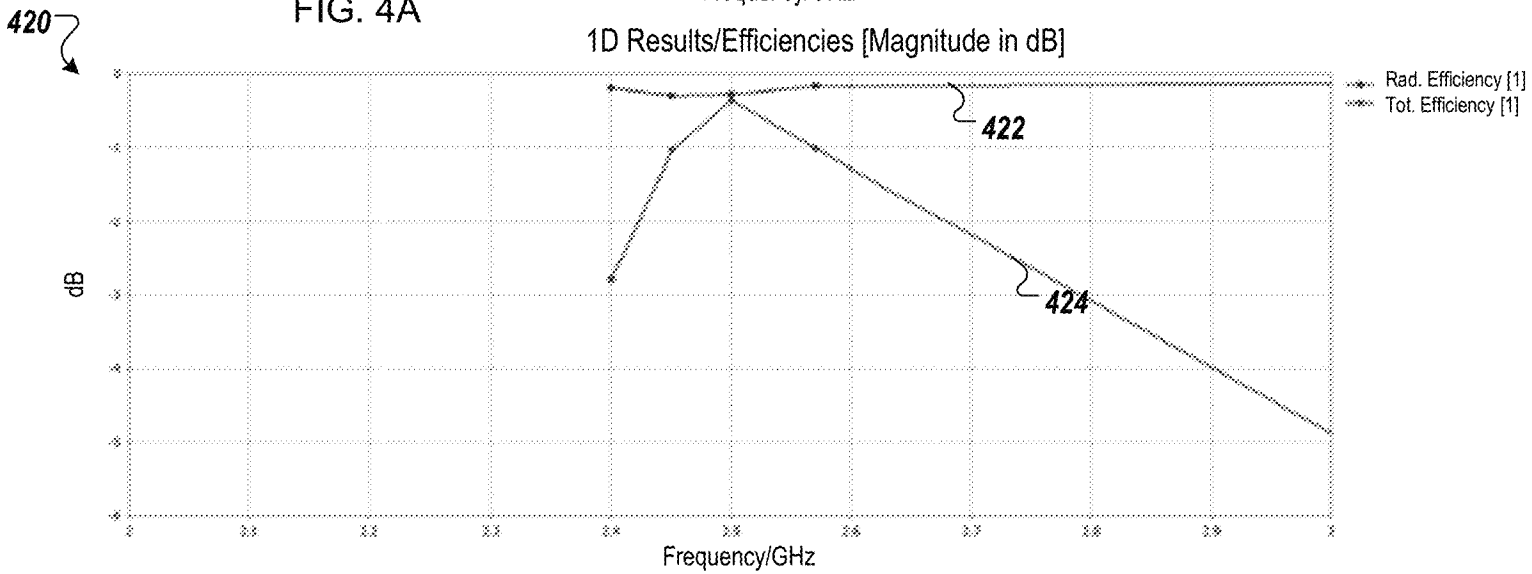
FIG. 4B is a graph of the radiation efficiency and a total efficiency of the low-profile cylindrical antenna structure of FIG. 1.

FIG. 4B is a graph 420 of the radiation efficiency 422 and a total efficiency 424 of the low-profile cylindrical antenna structure 100 of FIG. 1. The graph 420 shows radiation efficiency 422 of the cylindrical antenna structure 100 for the 2.4 GHz frequency band. The graph 420 also shows the total efficiency 424 of the cylindrical antenna structure 100 for the 2.4 GHz frequency band. The peak efficiency can be tuned according to the need of the frequency band of operation in the 2.4 GHz band. The graph 420 illustrates that the cylindrical antenna structure 100 is a viable antenna for WLAN and PAN frequency ranges. The graph 420 indicates that the cylindrical antenna structure 100 has high efficiency.

Figures 4C, 4D:
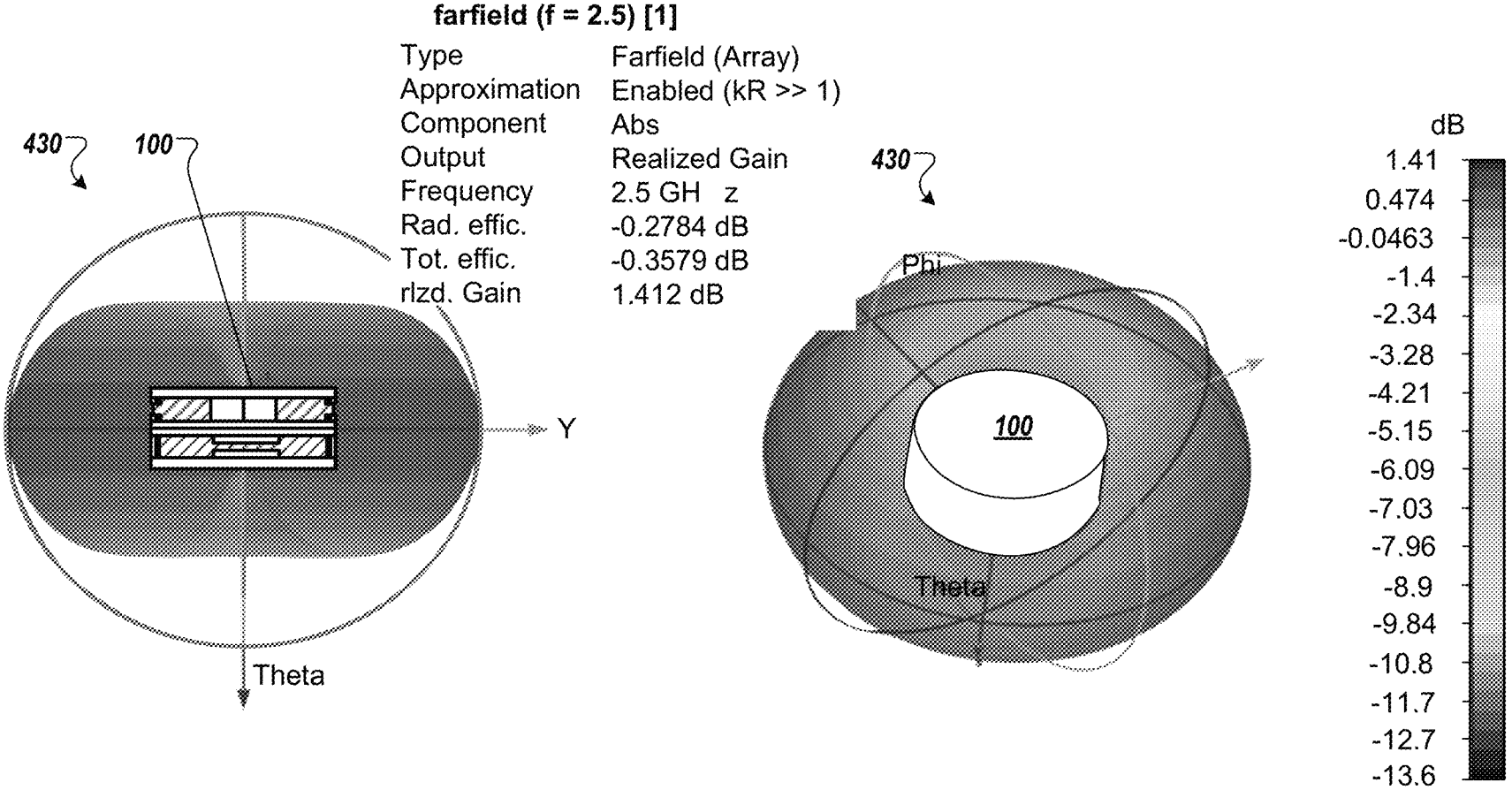
FIG. 4C is a side view of an omnidirectional radiation pattern of the low-profile cylindrical antenna structure of FIG. 1.
FIG. 4D is a perspective view of the omnidirectional radiation pattern of the low-profile cylindrical antenna structure of FIG. 1.
Figure 4E:
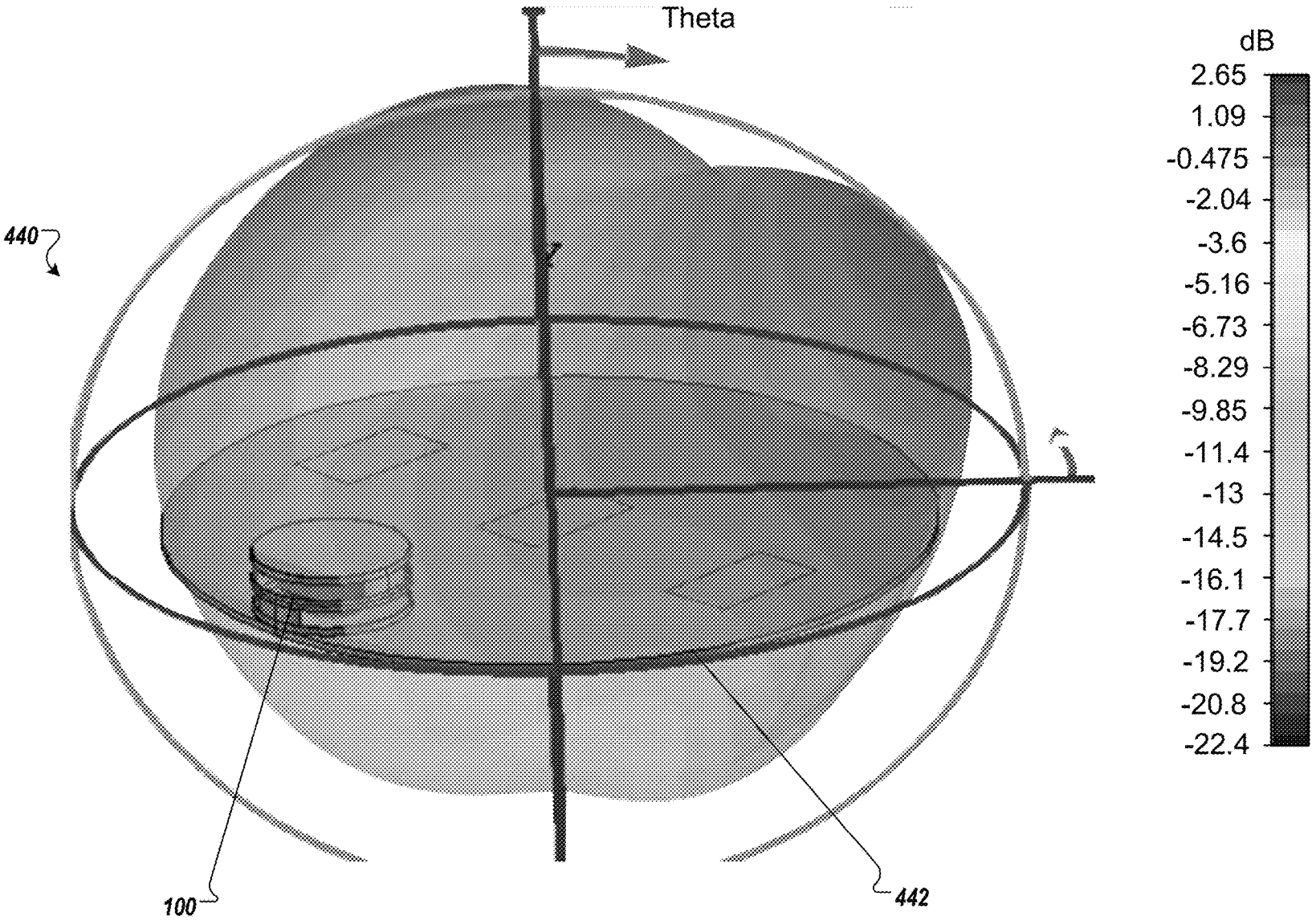
FIG. 4E is a perspective view of a spherical radiation pattern when the low-profile cylindrical antenna structure of FIG. 1 is placed above a ground plane of a circuit board according to one embodiment.

As described herein, the four slot opening of the cylindrical antenna structure 100 radiate as an omnidirectional antenna. An omnidirectional antenna is a transmitting or receiving antenna that radiates or intercepts RF electromagnetic fields equally well in all horizontal directions in a flat, two-dimensional (2D) geometric plane. The dipole with half wavelength exhibits omnidirectional properties in a horizontal (azimuth) plane. Similarly, the cylindrical antenna structure 100 radiates or intercepts electromagnetic fields equally well in all horizontal directions in the flat, 2D geometric plane (azimuth plane), as illustrated in FIGS. 4C-4D in free space. FIG. 4C is a side view of an omnidirectional radiation pattern 430 of the low-profile cylindrical antenna structure 100 of FIG. 1. FIG. 4D is a perspective view of the omnidirectional radiation pattern 430 of the low-profile cylindrical antenna structure 100 of FIG. 1. It should be noted that the slots of the cylindrical antenna structure 100 in FIG. 4D are not shown. The omnidirectional radiation pattern 430 is in free space. However, the cylindrical antenna structure 100 can also be placed by surrounding objects, such as a ground plane, that distorts the radiation and reception pattern of the cylindrical antenna structure 100 as illustrated in FIG. 4E. FIG. 4E is a perspective view of a low peak gain spherical radiation pattern 440 when the low-profile cylindrical antenna structure 100 of FIG. 1 is placed above a ground plane 442 of a circuit board according to one embodiment. In free space, the cylindrical antenna structure 100, operating at 2.5 GHz, has a realized gain of 1.412 dB, with −0.2784 dB radiation efficiency and −0.3579 total efficiency with the omnidirectional radiation pattern 430. The omnidirectional radiation pattern 430 has the realized gain at the side edges of the radiation pattern in both directions of the horizontal plane. When disposed above the ground plane 442, the cylindrical antenna structure 100, operating at 2.5 GHz, has a realized gain of 2.65 dB with the spherical radiation pattern 440. The spherical radiation pattern 440 has the realized gain at the edges that are higher in the horizontal plane and on the same side of the cylindrical antenna structure 100, as opposed to opposite sides in the omnidirectional radiation pattern 430.

Figure 4F:
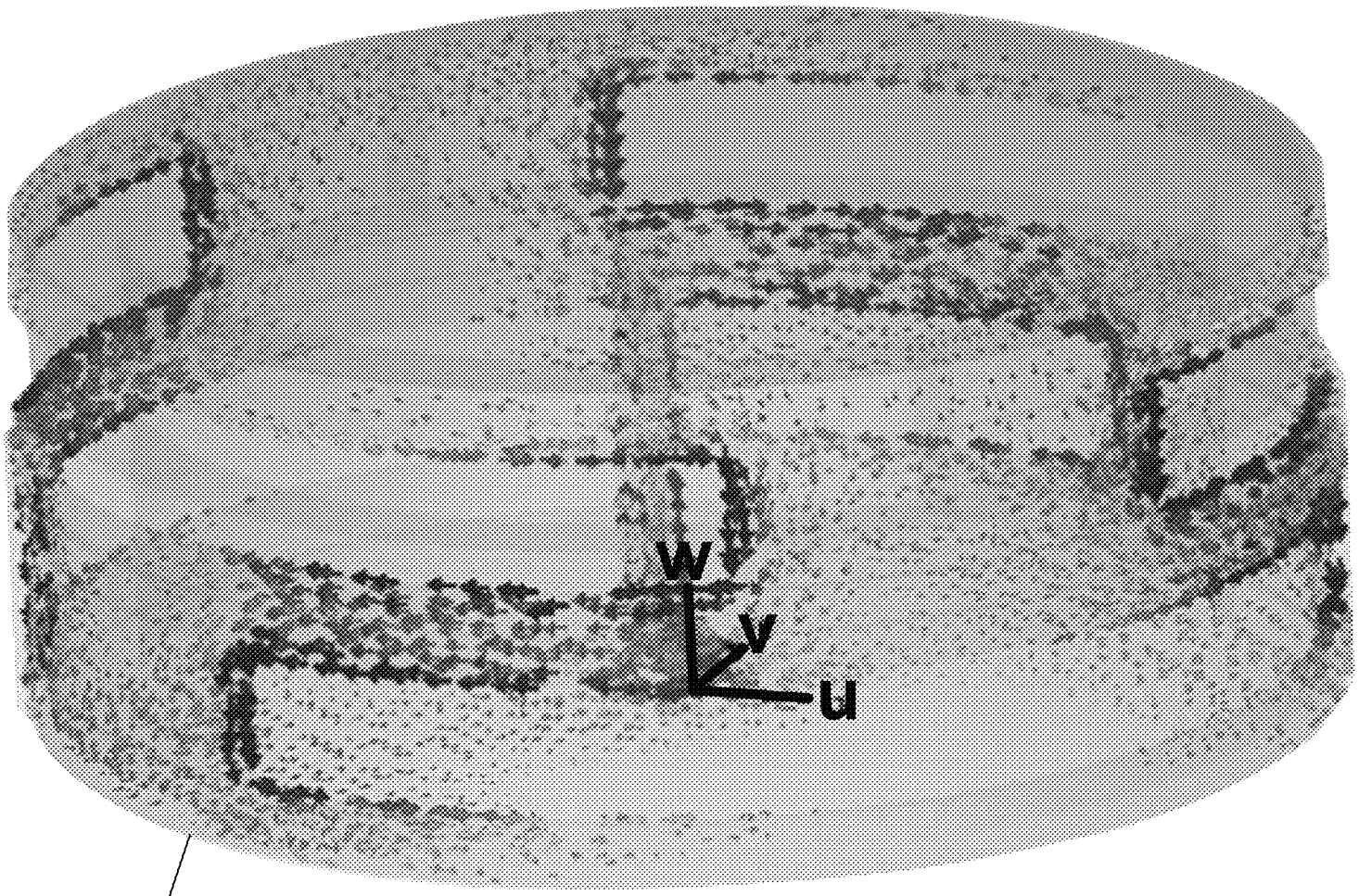
FIG. 4F is a perspective view illustrating a current distribution of the radiating slot openings of the low-profile cylindrical antenna structure of FIG. 1.

FIG. 4F is a perspective view illustrating a current distribution 450 of the radiating slot openings of the low-profile cylindrical antenna structure 100 of FIG. 1. The current distribution 450 shows increased currents between alternating slot openings of the cylindrical antenna structure 100. Referring back to FIGS. 3C-3D, the increased currents are located at regions 330 of the metal between the respective slot openings.

As a point of comparison, an omnidirectional dipole type radiation pattern with much higher height (0.5λ) of the dipole than the lower height (0.1λ) of the cylindrical antenna structure 100 that produces the omnidirectional radiation pattern 430 or the low peak spherical radiation pattern 440. In free space, the omnidirectional radiation pattern 430 has a low peak gain of 1.41 dBi. Above the ground plane 442, the spherical radiation pattern 440 has a peak gain of 2.65 dBi. In this example, the height of the cylindrical antenna structure 100 is approximately 12 mm as compared to the height of the dipole would be 60 mm for 2.4 GHz.

Figure 5:
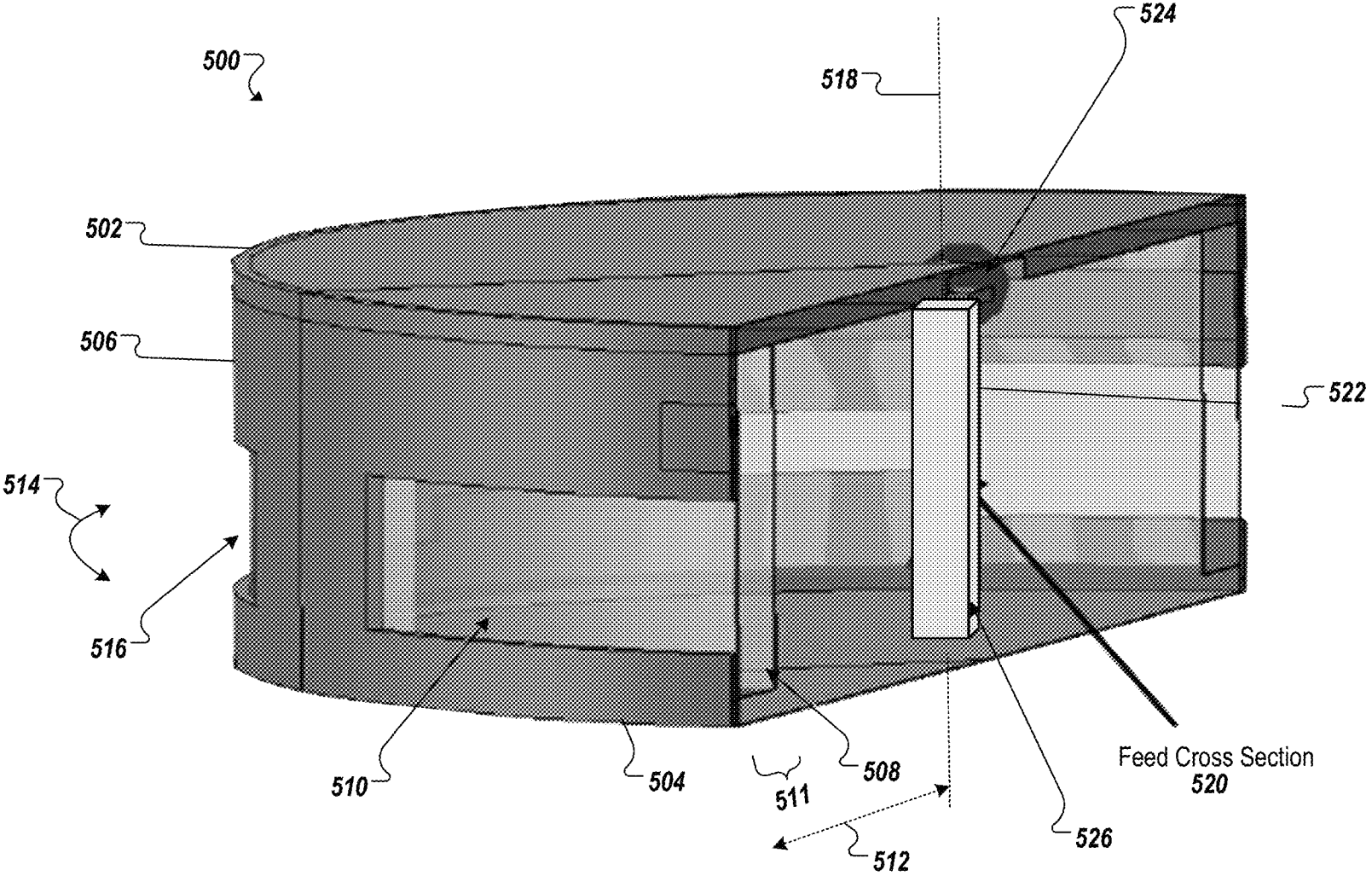
FIG. 5 is a cross-sectional view of a low-profile cylindrical antenna structure that generates a bi-directional radiation pattern according to one embodiment.

FIG. 5 is a cross-sectional view of a low-profile cylindrical antenna structure 500 that generates a bi-directional radiation pattern according to one embodiment. The cylindrical antenna structure 500 can be part of a wireless device having one or more radios to communicate data to another wireless device. The cylindrical antenna structure 500 is made up of metal and can be at least partially filled with dielectric material. The cylindrical antenna structure 500 includes a top surface 502, a bottom surface 504, and a side wall 506 with a first height between the top surface 502 and the bottom surface 504. The first height is what makes the cylindrical antenna structure 500 considered low profile and can be similar to the heights described above with respect to FIG. 1. In general, the first height can be equal to or less than half wavelength (0.5λ) of an operating frequency range of the cylindrical antenna structure 500.

As illustrated in FIG. 5, the top surface 502, the bottom surface 504, and the side wall 506 form a right circular, hollow cylinder. Alternatively, the cylindrical antenna structure 500 can have an oblique hollow cylinder. In other embodiments, the cylindrical antenna structure 500 can be other shapes, such as shapes with flat surfaces, curved surfaces, edges, or the like.

As illustrated in FIG. 5, the side wall 506 includes a first slot 510 in the metal. The first slot 510 is centered at a first point on the side wall 506 at a second height from the bottom surface 504 and is oriented longitudinally along an azimuthal direction 514 of the cylindrical antenna structure 500. The side wall 506 includes a second slot 516 that is centered at a second point on the side wall 506 at the second height and is oriented longitudinally along the azimuthal direction, the second point being diametrically opposite the first point about a center axis 518 of the cylindrical antenna structure 500. Unlike the cylindrical antenna structure 100, the cylindrical antenna structure 500 does not include the third and fourth slots. In some embodiments, the points of the elongated slots are diametrically opposite one another in a first plane. Alternatively, the elongated slots can be asymmetrical relative to one another or partially asymmetrical relative to one another.

In the illustrated embodiment, the slots 510 and 516 are identical in shape and size. Alternatively, different shapes can be used than those illustrated. In some embodiments, the slots are rectangular. In other embodiments, the slots can include sections of the rectangle that achieve a longer effective length of the slot opening, such as illustrated in FIG. 5. Additional details regarding the shape of the slots are described below with respect to FIGS. 6A-6D.

As illustrated in FIG. 5, a coupled feed structure 520 is used to feed the cylindrical antenna structure 500. A radio of the wireless device is coupled to the coupled feed structure 520 and applies an RF signal to the coupled feed structure to radiate electromagnetic energy in the omnidirectional radiation pattern. That is, the cylindrical antenna structure 500 is configured to radiate electromagnetic energy in the bi-directional radiation pattern, responsive to the RF signal being applied to the coupled feed structure 520. Alternatively, the radio can receive an RF signal detected by the cylindrical antenna structure 500.

The coupled feed structure 520 can be coupled to a radio of the wireless device and can have a metal member 522 located on the center axis 518 that is physically separated from the top surface 502 and the bottom surface 504. That is, there is a first gap 524 between the metal member 522 and the top surface 502 and a second gap 526 between the metal member 522 and the bottom surface 504.

In some embodiments, an antenna carrier can be disposed within the cylindrical antenna structure 500. As illustrated in FIG. 5, a second cylindrical structure 508 of dielectric material (also referred to as an antenna carrier) is located within the cylindrical antenna structure 500. The second cylindrical structure 508 has a center axis that is the same as the center axis 518 of the cylindrical antenna structure 500. An outer surface of the second cylindrical structure 508 is adjacent to an inner surface of the cylindrical antenna structure 500. The second cylindrical structure 508 has a thickness 511 that is less than a radius 512 of the cylindrical antenna structure 500.

Figure 6B:
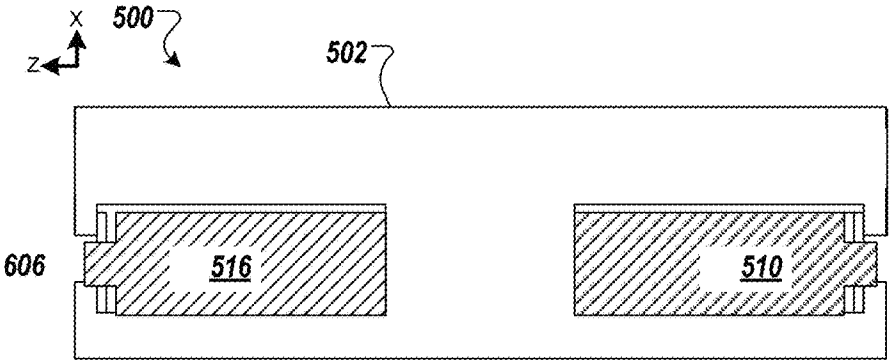
FIG. 6B is a left-side view of the low-profile cylindrical antenna structure of FIG. 5.
Figure 6A:
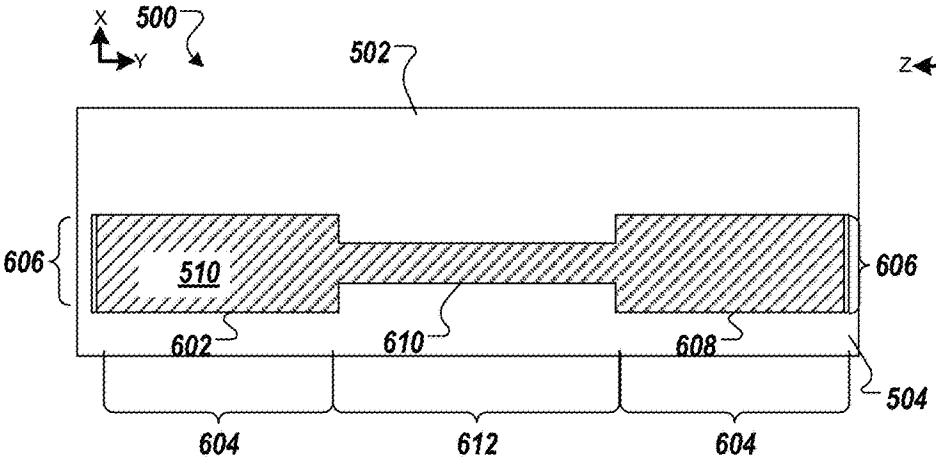
FIG. 6A is a front view of the low-profile cylindrical antenna structure of FIG. 5.

FIG. 6A is a front view of the low-profile cylindrical antenna structure 500 of FIG. 5. The front view shows the first slot opening 510 in the metal as including a first rectangular portion 602 with a second length 604 in the azimuthal direction and a first width 606 perpendicular to the azimuthal direction; a second rectangular portion 608 with the second length 604 along in the azimuthal direction and the first width 606 perpendicular to the azimuthal direction; and a third rectangular portion 610 with a third length 612 in the azimuthal direction and a second width perpendicular to the azimuthal direction, the second width being less than the first width 606. The third rectangular portion 610 is located between the first rectangular portion 602 and the second rectangular portion 608 in the azimuthal direction.

FIG. 6B is a left-side view of the low-profile cylindrical antenna structure 500 of FIG. 5. The left-side view shows the portions of the first slot opening 510 and portions of the second slot opening 516.

Figure 6D:
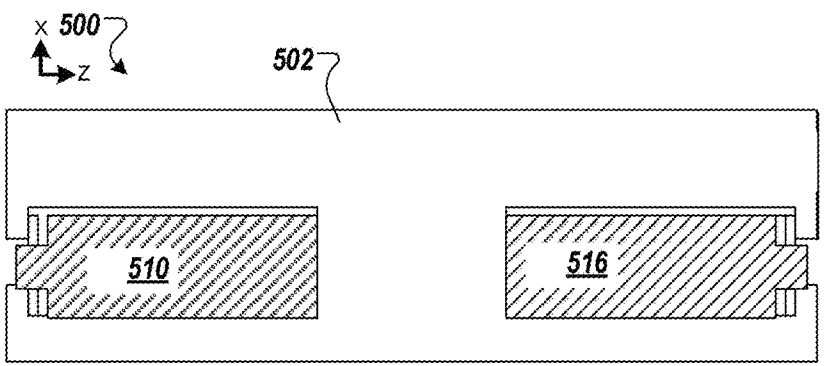
FIG. 6D is a right-side view of the low-profile cylindrical antenna structure of FIG. 5.
Figure 6C:
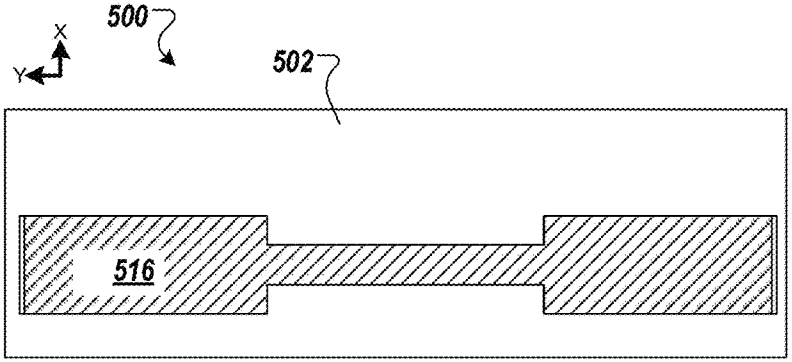
FIG. 6C is a back view of the low-profile cylindrical antenna structure of FIG. 5.

FIG. 6C is a back view of the low-profile cylindrical antenna structure 500 of FIG. 5. The back view shows the second slot opening 516 in the metal as including a fourth rectangular portion with the second length in the azimuthal direction and the first width perpendicular to the azimuthal direction; an fifth rectangular portion with the second length along in the azimuthal direction and the first width perpendicular to the azimuthal direction; and a sixth rectangular portion with the third length in the azimuthal direction and the second width perpendicular to the azimuthal direction, the second width being less than the first width. The sixth rectangular portion is located between the fourth rectangular portion and the fifth rectangular portion in the azimuthal direction.

FIG. 6D is a right-side view of the low-profile cylindrical antenna structure 500 of FIG. 5. The right-side view shows the other portions of the first slot opening 510 and the other portions of the second slot opening 516.

FIGS. 6A-6D show the cylindrical antenna structure with two slots on the side wall. All of the slots are fed by a coupled feed structure. Each slot is excited by the coupled feed at the same time and at the same frequency.

Figure 7A:
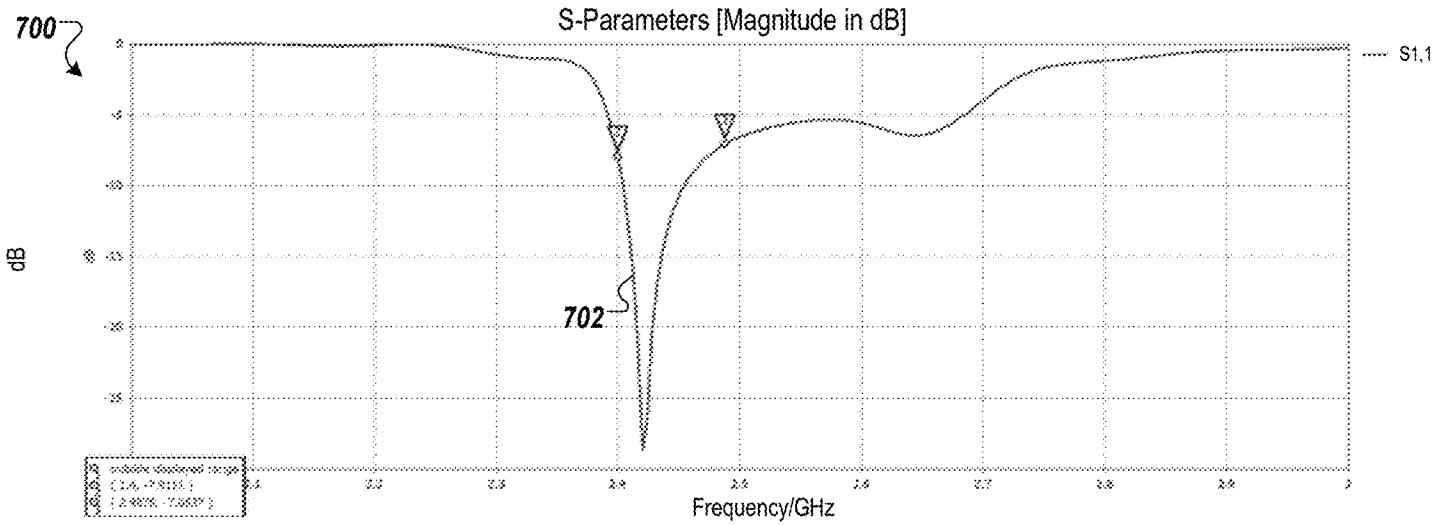
FIG. 7A is a graph of s-parameters of the low-profile cylindrical antenna structure of FIG. 5.

FIG. 7A is a graph 700 of s-parameters of the low-profile cylindrical antenna structure 500 of FIG. 5. The S-parameters indicates an amount of power reflected at antennas coupled to the ports of the radios of a wireless device. For example, $S_{11}$ 702 represents an amount of power reflected by the cylindrical antenna structure 500 coupled to the port of the radio. The graph 700 may indicate that the $S_{11}$ 702 is below approximately −7 dB for frequencies between 2.4 GHz and 2.5 GHz. The graph 700 indicates that the cylindrical antenna structure 500 has good bandwidth.

Figure 7B:
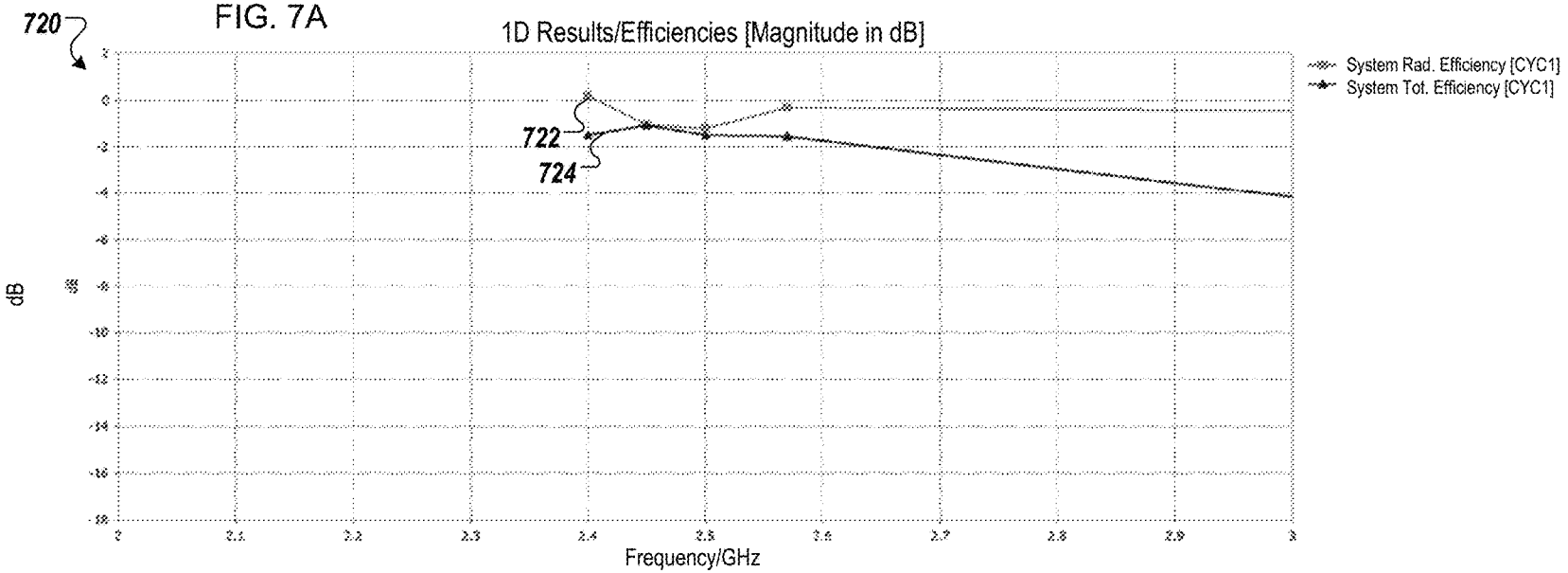
FIG. 7B is a graph of the radiation efficiency and a total efficiency of the low-profile cylindrical antenna structure of FIG. 5.

FIG. 7B is a graph 720 of the radiation efficiency and a total efficiency of the low-profile cylindrical antenna structure 500 of FIG. 5. The graph 720 shows radiation efficiency 722 of the cylindrical antenna structure 500 for the 2.4 GHz frequency band. The graph 720 also shows the total efficiency 724 of the cylindrical antenna structure 500 for the 2.4 GHz frequency band. The graph 720 illustrates that the cylindrical antenna structure 500 is a viable antenna for WLAN and PAN frequency ranges. The graph 720 indicates that the cylindrical antenna structure 500 has high efficiency.

Figures 7C, 7D, 7E:
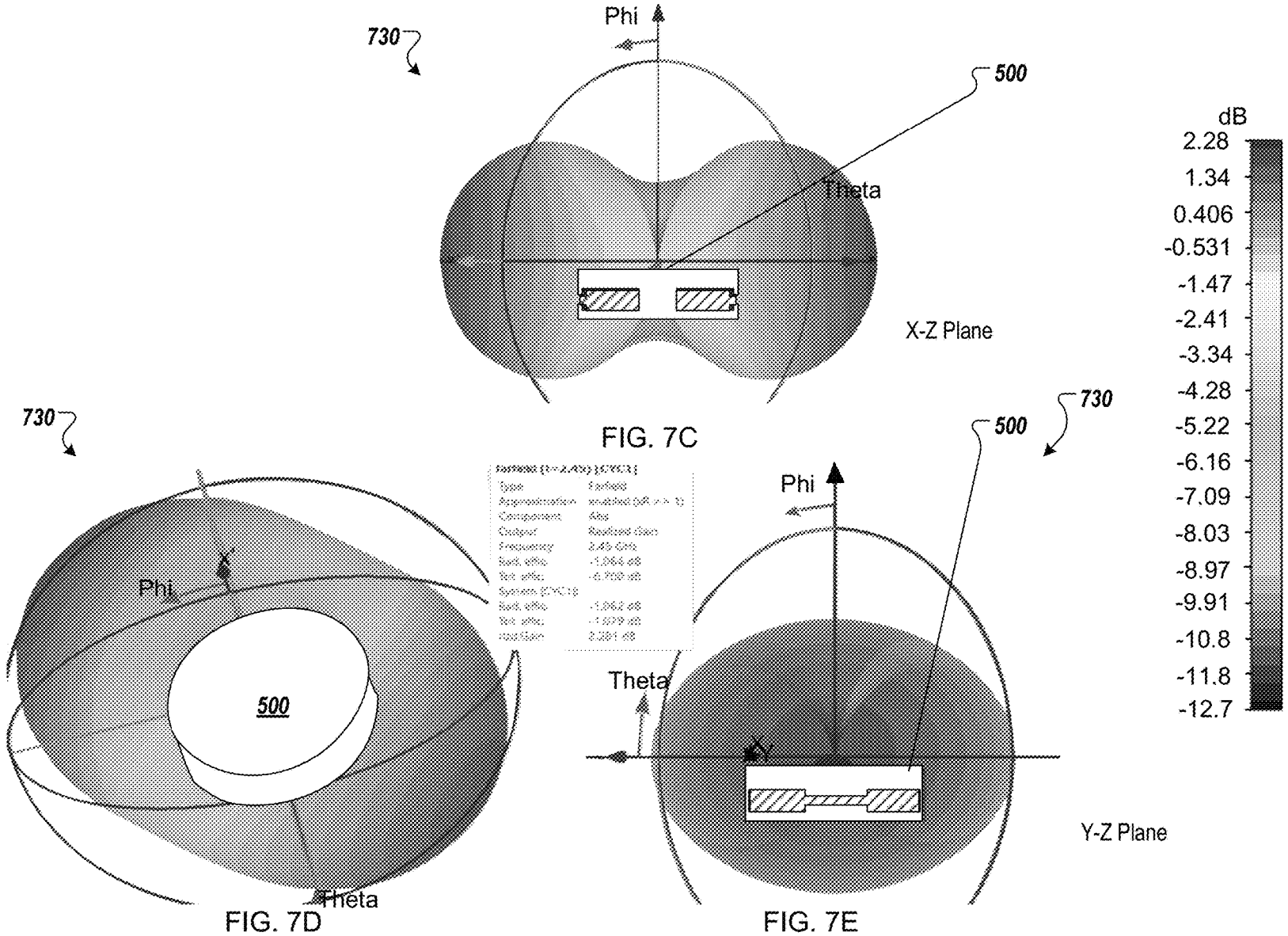
FIG. 7C is a first side view of a bi-directional radiation pattern of the low-profile cylindrical antenna structure of FIG. 5.
FIG. 7D is a perspective view of the bi-directional radiation pattern of the low-profile cylindrical antenna structure of FIG. 5.
FIG. 7E is a second side view of the bi-directional radiation pattern of the low-profile cylindrical antenna structure of FIG. 5.
Figure 7F:
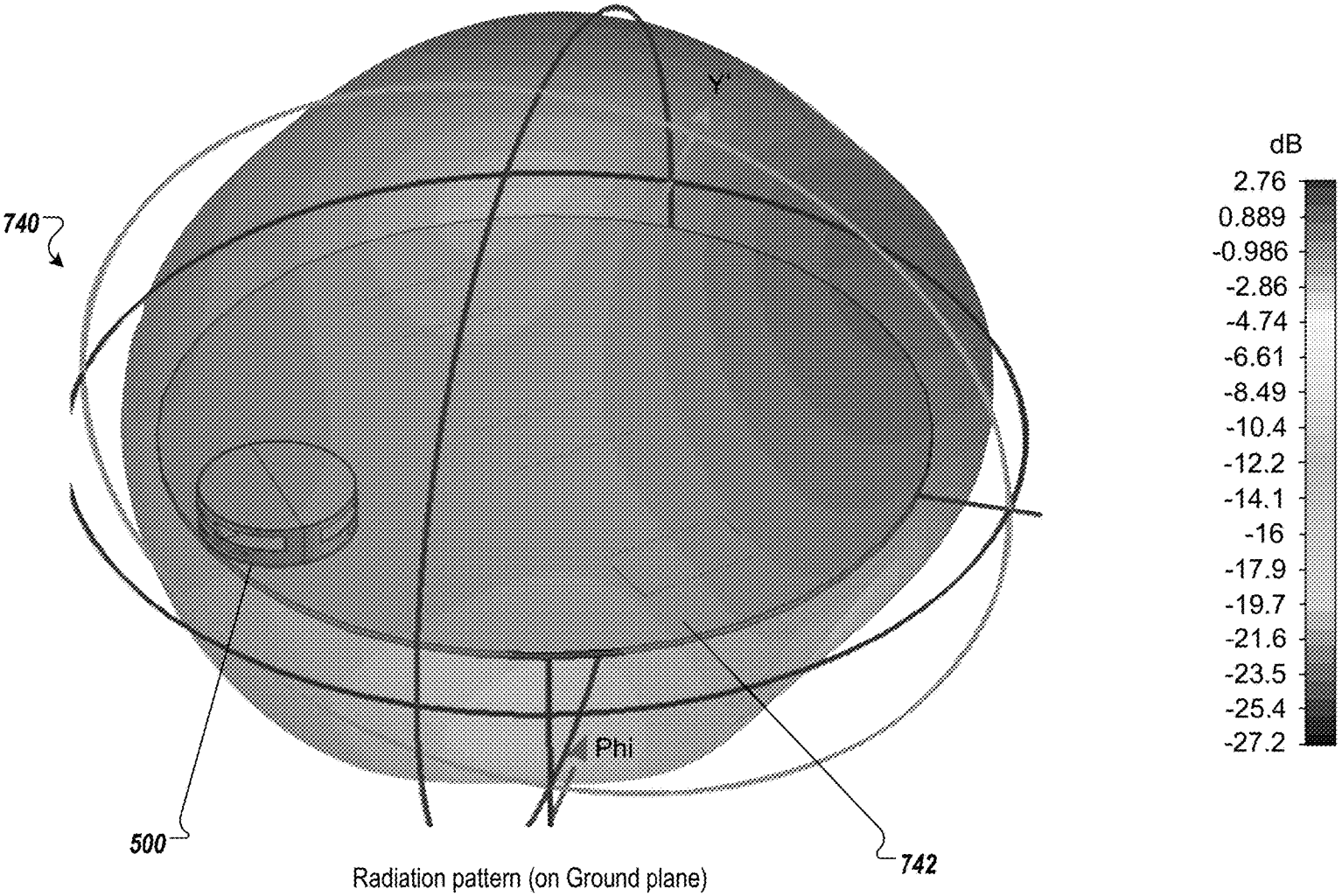
FIG. 7F is a perspective view of a spherical radiation pattern when the low-profile cylindrical antenna structure of FIG. 5 is placed above a ground plane of a circuit board according to one embodiment.

As described herein, the four slot opening of the cylindrical antenna structure 100 radiate as an omnidirectional antenna. As such, the cylindrical antenna structure 100 radiates or intercepts electromagnetic fields equally well in all horizontal directions in the flat, 2D geometric plane (azimuth plane), as illustrated in FIGS. 4C-4D. The two slot openings of the cylindrical antenna structure 500 radiate as a modified omnidirectional radiation pattern, also referred to a low gain bi-directional radiation pattern. As such, the cylindrical antenna structure 500 radiates or intercepts electromagnetic fields equally well in two horizontal directions in the flat, 2D geometric plane (azimuth plane), as illustrated in FIGS. 7C-7D in free space. FIG. 7C is a first side view of a bi-directional radiation pattern 730 of the low-profile cylindrical antenna structure 500 of FIG. 5. FIG. 7D is a perspective view of the bi-directional radiation pattern 730 of the low-profile cylindrical antenna structure 500 of FIG. 5. It should be noted that the slots of the cylindrical antenna structure 500 in FIG. 7D are not shown. FIG. 7E is a second side view of a bi-directional radiation pattern 730 of the low-profile cylindrical antenna structure 500 of FIG. 5. The bi-directional radiation pattern 730 is in free space. However, the cylindrical antenna structure 500 may be placed by surrounding objects, such as a ground plane, that distorts the radiation and reception pattern of the cylindrical antenna structure 500 as illustrated in FIG. 7F. FIG. 7F is a perspective view of a spherical radiation pattern 740 when the low-profile cylindrical antenna structure 500 of FIG. 5 is placed above a ground plane 742 of a circuit board according to one embodiment. In free space, the cylindrical antenna structure 500, operating at 2.45 GHz, has a realized gain of 2.28 dB, with −1.062 dB radiation efficiency and −1.079 dB total efficiency with the bi-directional radiation pattern 730. The bi-directional radiation pattern 730 has the realized gain at the side edges of the radiation pattern in both directions of the horizontal plane. When disposed above the ground plane 742, the cylindrical antenna structure 500, operating at 2.45 GHz, has a realized gain of 2.76 dB with the spherical radiation pattern 740. The spherical radiation pattern 740 has the realized gain at the edges that are higher in the horizontal plane and on the same side of the cylindrical antenna structure 500, as opposed to opposite sides in the omnidirectional radiation pattern 730.

Figure 8:
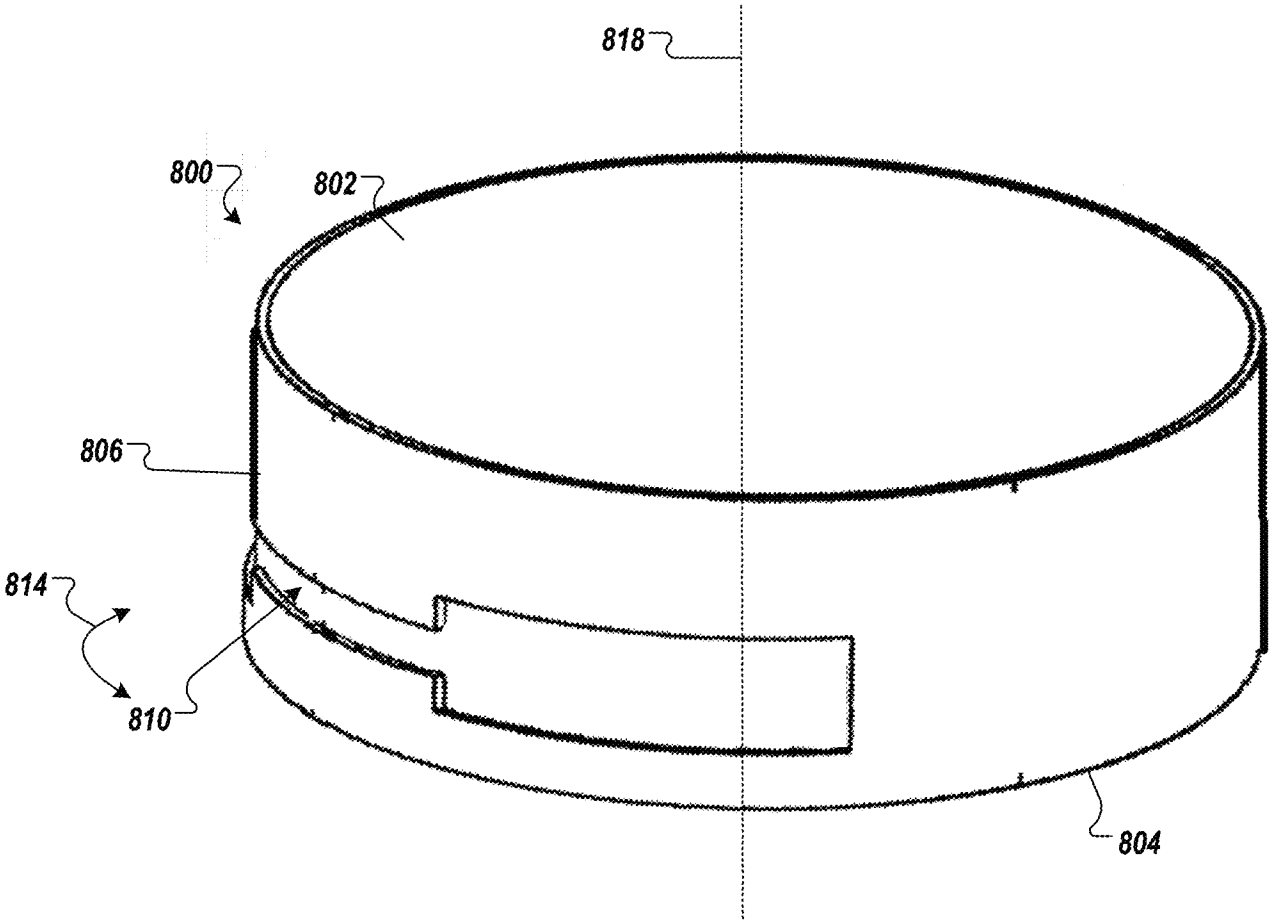
FIG. 8 is a perspective view of a low-profile cylindrical antenna structure that generates an omnidirectional radiation pattern according to one embodiment.

FIG. 8 is a perspective view of a low-profile cylindrical antenna structure 800 that generates an omnidirectional radiation pattern according to one embodiment. The cylindrical antenna structure 800 can be part of a wireless device having one or more radios to communicate data to another wireless device. The cylindrical antenna structure 800 is made up of metal and can be at least partially filled with dielectric material. The cylindrical antenna structure 800 includes a top surface 802, a bottom surface 804, and a side wall 806 with a first height between the top surface 802 and the bottom surface 804. The first height is what makes the cylindrical antenna structure 800 considered low profile and can be similar to the heights described above with respect to FIG. 1. In general, the first height can be equal to or less than half wavelength (0.5λ) of an operating frequency range of the cylindrical antenna structure 800.

As illustrated in FIG. 8, the top surface 802, the bottom surface 804, and the side wall 806 form a right circular, hollow cylinder. Alternatively, the cylindrical antenna structure 800 can have an oblique hollow cylinder. In other embodiments, the cylindrical antenna structure 800 can be other shapes, such as shapes with flat surfaces, curved surfaces, edges, or the like.

As illustrated in FIG. 8, the side wall 806 includes a single slot 810 in the metal. The single slot 810 is centered at a first point on the side wall 806 at a second height from the bottom surface 804 and is oriented longitudinally along an azimuthal direction 814 of the cylindrical antenna structure 800. Unlike the cylindrical antenna structure 100 that includes four slot openings and the cylindrical antenna structure 500 that includes two slot openings, the cylindrical antenna structure 800 includes only one slot opening. In some embodiments, the single slot 810 is rectangular. In other embodiments, the single slot 810 can include sections of the rectangle that achieve a longer effective length of the slot opening, such as illustrated in FIG. 8. Additional details regarding the shape of the slots are described below with respect to FIGS. 9A-9D.

Although not illustrated in FIG. 8, a coupled feed structure is used to feed the cylindrical antenna structure. A radio of the wireless device is coupled to the coupled feed structure and applies an RF signal to the coupled feed structure to radiate electromagnetic energy in the omnidirectional radiation pattern. That is, the cylindrical antenna structure 800 is configured to radiate electromagnetic energy in the omnidirectional radiation pattern, responsive to the RF signal being applied to the coupled feed structure. Alternatively, the radio can receive an RF signal detected by the cylindrical antenna structure. The coupled feed structure can be coupled to a radio of the wireless device and can have a metal member located on the center axis that is physically separated from the top surface 802 and the bottom surface 804. That is, there is a first gap between the metal member and the top surface 802 and a second gap between the metal member and the bottom surface 804.

In some embodiments, an antenna carrier can be disposed within the cylindrical antenna structure 800. Although not illustrated in FIG. 8, a second cylindrical structure of dielectric material (also referred to herein as an antenna carrier) can be located within the cylindrical antenna structure 800. The second cylindrical structure has a center axis that is the same as the center axis 818 of the cylindrical antenna structure 800. An outer surface of the second cylindrical structure is adjacent to an inner surface of the cylindrical antenna structure 800. The second cylindrical structure has a thickness that is less than a radius of the cylindrical antenna structure 800.

Figure 9B:
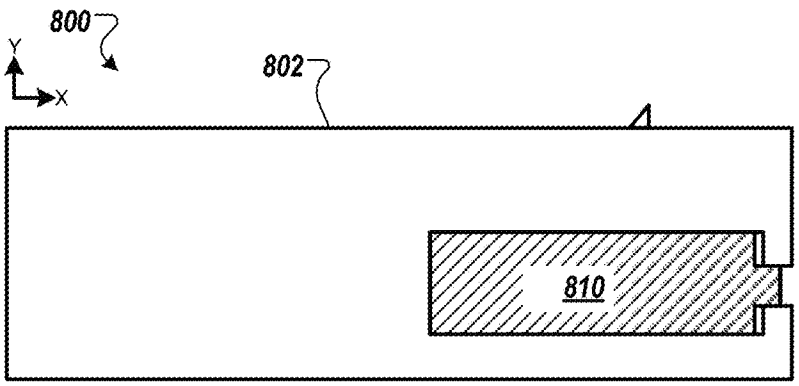
FIG. 9B is a left-side view of the low-profile cylindrical antenna structure of FIG. 8.
Figure 9A:
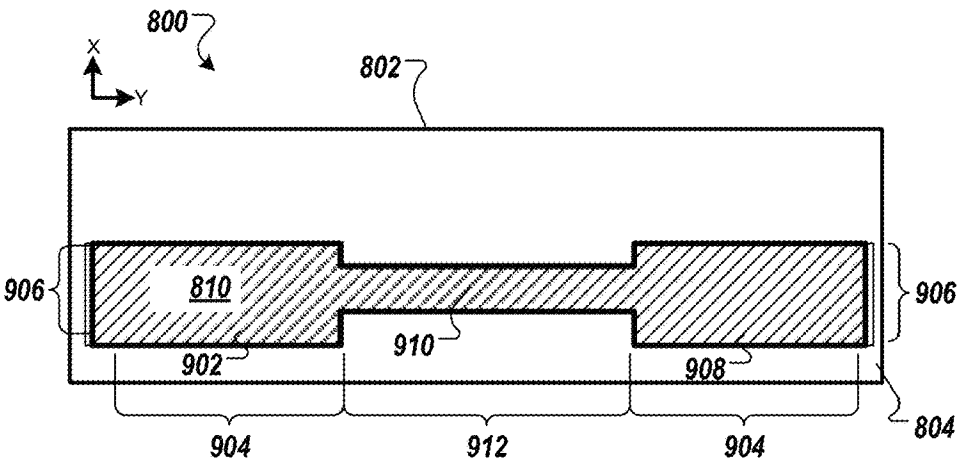
FIG. 9A is a front view of the low-profile cylindrical antenna structure of FIG. 8.
Figure 9D:
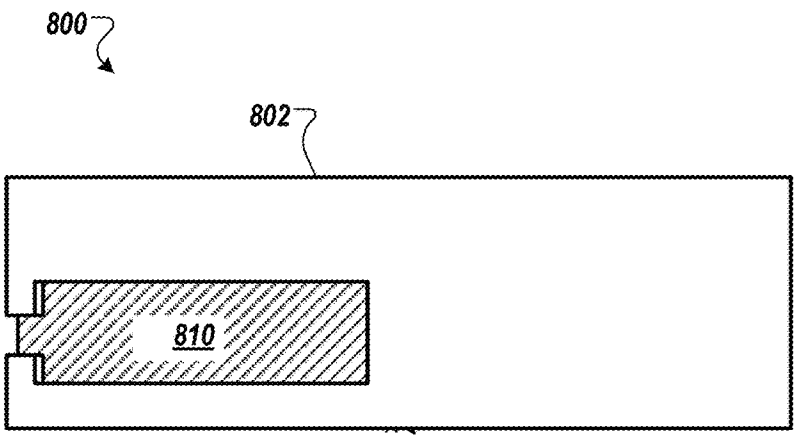
FIG. 9D is a right-side view of the low-profile cylindrical antenna structure of FIG. 8.
Figure 9C:
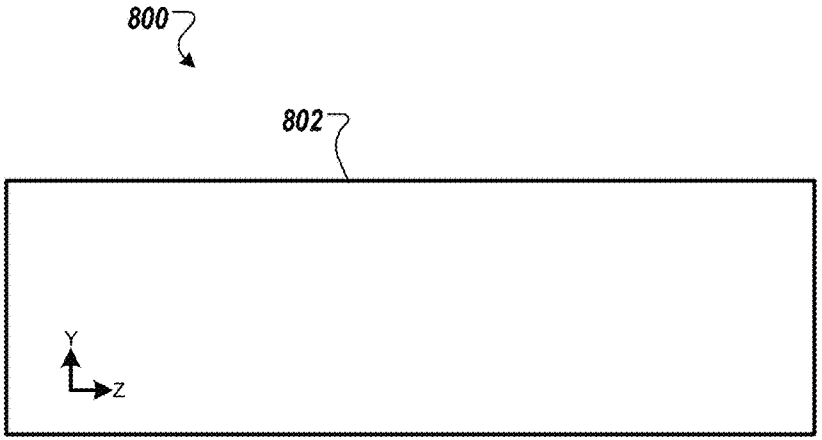
FIG. 9C is a back view of the low-profile cylindrical antenna structure of FIG. 8.

FIG. 9A is a front view of the low-profile cylindrical antenna structure 800 of FIG. 8. The front view shows the single slot 810 in the metal as including a first rectangular portion 902 with a second length 904 in the azimuthal direction and a first width 906 perpendicular to the azimuthal direction; a second rectangular portion 908 with the second length 904 along in the azimuthal direction and the first width 906 perpendicular to the azimuthal direction; and a third rectangular portion 910 with a third length 912 in the azimuthal direction and a second width perpendicular to the azimuthal direction, the second width being less than the first width 906. The third rectangular portion 910 is located between the first rectangular portion 902 and the second rectangular portion 908 in the azimuthal direction. FIG. 9B is a left-side view of the low-profile cylindrical antenna structure 800 of FIG. 8. The left-side view shows a portion of the single slot 810. FIG. 9C is a back view of the low-profile cylindrical antenna structure 800 of FIG. 8. The back view does not show any portion of the single slot 810. FIG. 9D is a right-side view of the low-profile cylindrical antenna structure 800 of FIG. 8. The right-side view shows the other portion of the single slot 810.

FIGS. 9A-9D show the cylindrical antenna structure with a single slot on the side wall. The single slot is fed by a coupled feed structure at a frequency.

Figure 10A:
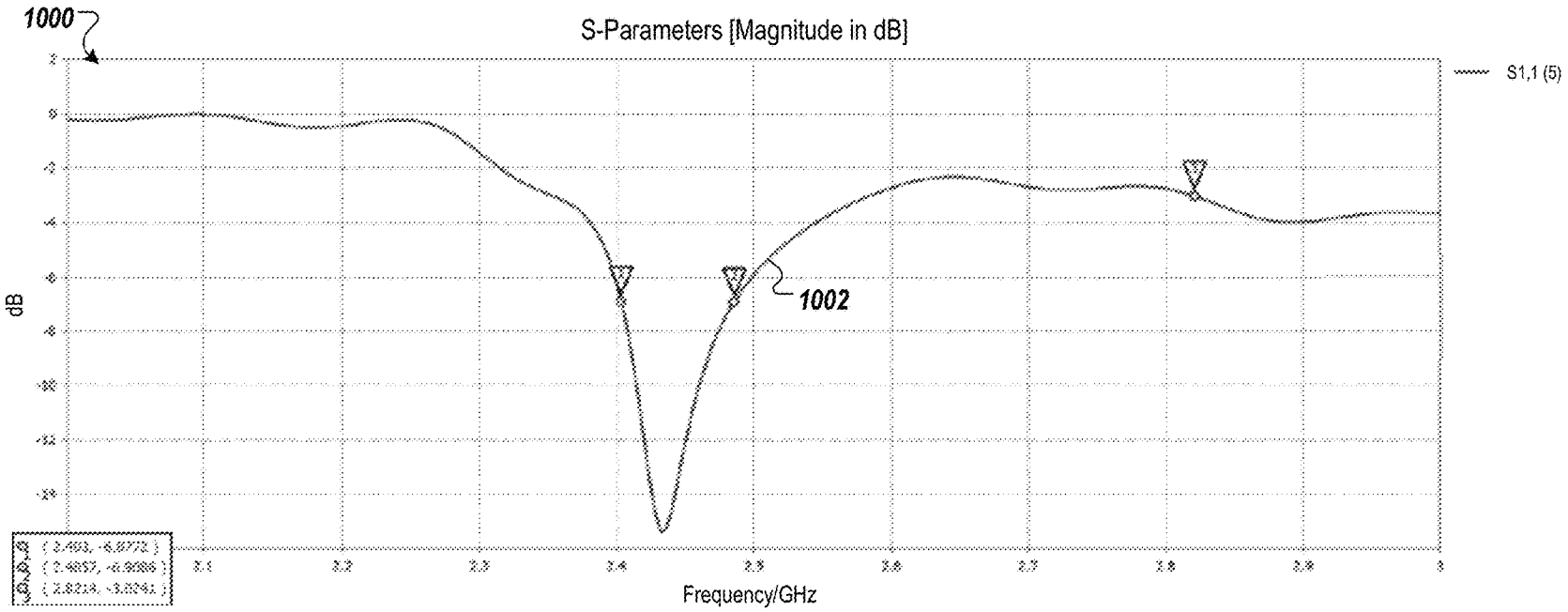
FIG. 10A is a graph of s-parameters of the low-profile cylindrical antenna structure of FIG. 8.

FIG. 10A is a graph 1000 of s-parameters of the low-profile cylindrical antenna structure 800 of FIG. 8. The S-parameters indicates an amount of power reflected at antennas coupled to the ports of the radios of a wireless device. For example, $S_{11}$ 1002 represents an amount of power reflected by the cylindrical antenna structure 800 coupled to the port of the radio. The graph 1000 may indicate that the $S_{11}$ 1102 is below approximately −6.5 dB for frequencies between 2.4 GHz and 2.485 GHz. The graph 1000 indicates that the cylindrical antenna structure 800 has good bandwidth.

Figure 10B:
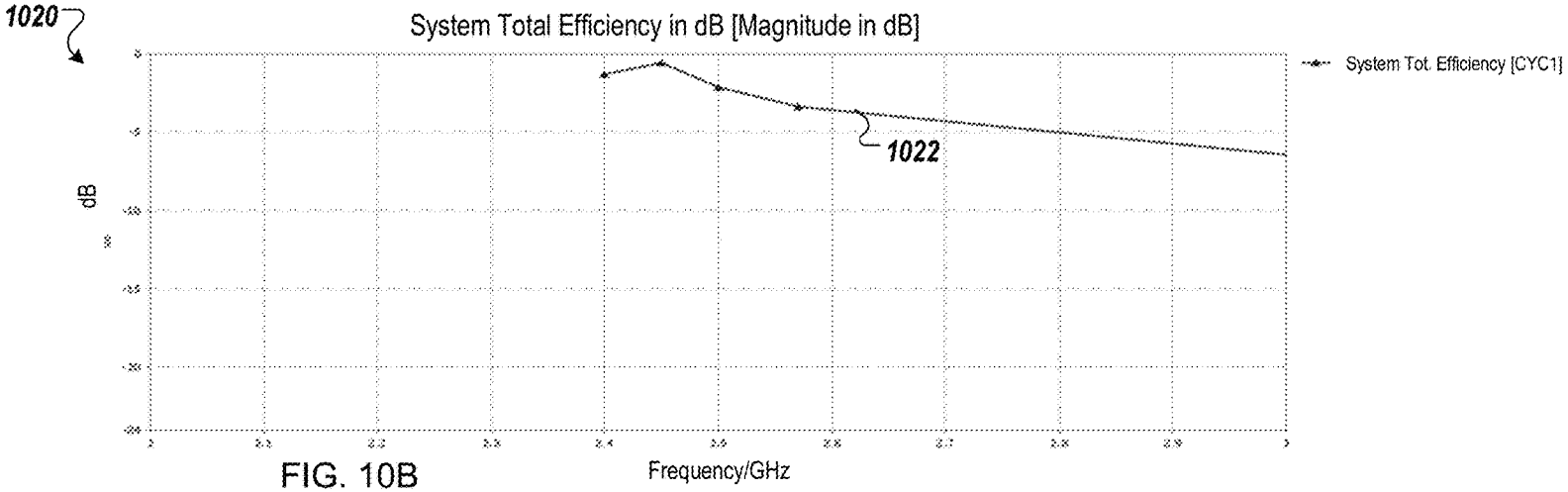
FIG. 10B is a graph of a total efficiency of the low-profile cylindrical antenna structure of FIG. 8.

FIG. 10B is a graph 1020 of a total efficiency of the low-profile cylindrical antenna structure 800 of FIG. 8. The graph 1020 shows the total efficiency 1022 of the cylindrical antenna structure 800 for the 2.4 GHz frequency band. The graph 1020 illustrates that the cylindrical antenna structure 800 is a viable antenna for WLAN and PAN frequency ranges. The graph 1020 indicates that the cylindrical antenna structure 800 has high efficiency.

As described herein, the four slot opening of the cylindrical antenna structure 100 radiate as an omnidirectional antenna. As such, the cylindrical antenna structure 100 radiates or intercepts electromagnetic fields equally well in all horizontal directions in the flat, 2D geometric plane (azimuth plane), as illustrated in FIGS. 4C-4D. The two slot openings of the cylindrical antenna structure 500 radiate as low gain bi-directional radiation pattern. As such, the cylindrical antenna structure 500 radiates or intercepts electromagnetic fields equally well in two horizontal directions in the flat, 2D geometric plane (azimuth plane), as illustrated in FIGS. 7C-7D in free space. The single slot opening of the cylindrical antenna structure 800 radiates as a modified omnidirectional radiation pattern in free space and a spherical radiation pattern when disposed above a ground plane. As such, the cylindrical antenna structure 800 radiates or intercepts electromagnetic fields equally well in horizontal directions in the flat, 2D geometric plane (azimuth plane), as illustrated in FIGS. 10C-10D in free space.

Figure 10C:
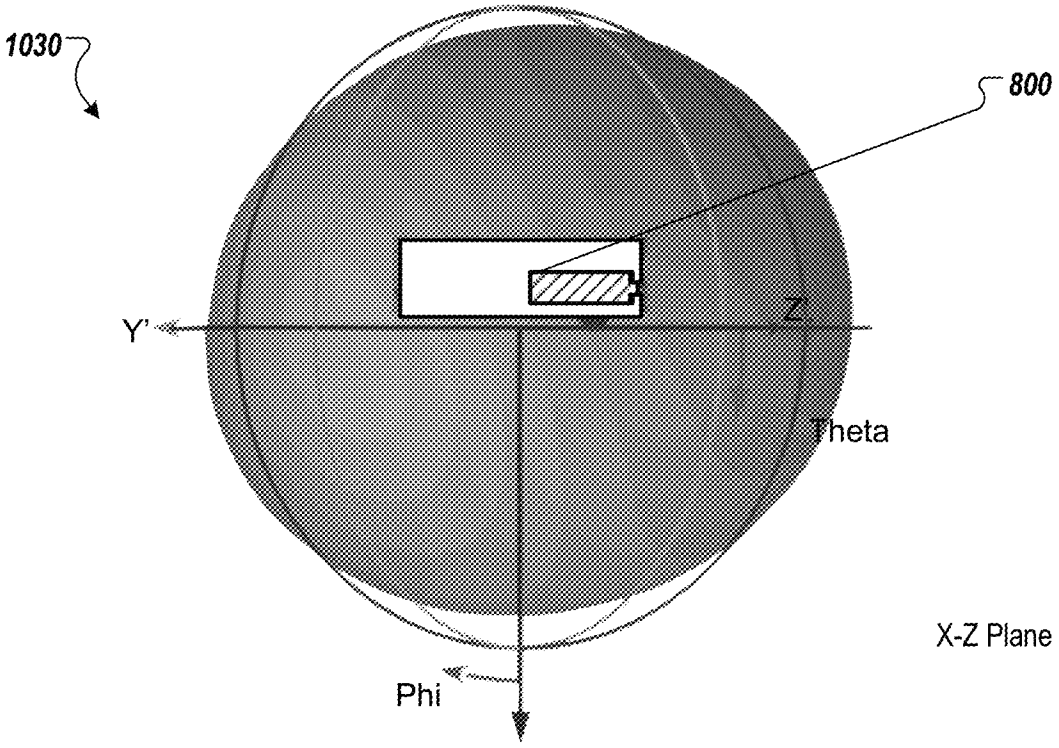
FIG. 10C is a side view of an omnidirectional radiation pattern of the low-profile cylindrical antenna structure of FIG. 8.
Figures 10D, 10E:
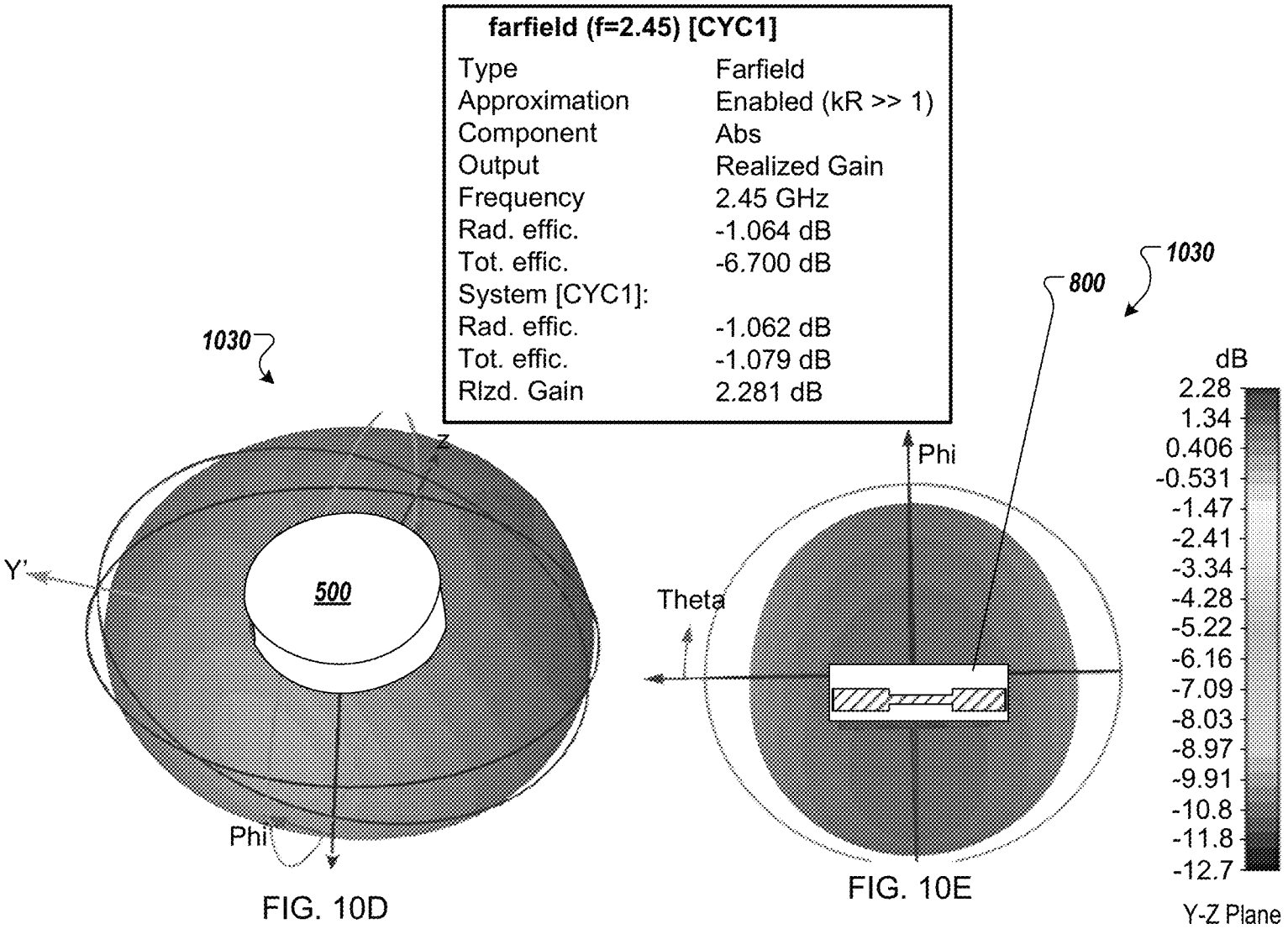
FIG. 10D is a perspective view of the omnidirectional radiation pattern of the low-profile cylindrical antenna structure of FIG. 8.
FIG. 10E is another side view of the omnidirectional radiation pattern of the low-profile cylindrical antenna structure of FIG. 8.

FIG. 10C is a side view of the omnidirectional radiation pattern 1030 of the low-profile cylindrical antenna structure 800 of FIG. 8. FIG. 10D is a perspective view of the omnidirectional radiation pattern 1030 of the low-profile cylindrical antenna structure 800 of FIG. 8. It should be noted that the slot of the cylindrical antenna structure 800 in FIG. 10D is not shown. FIG. 10E is another side view of the omnidirectional radiation pattern 1030 of the low-profile cylindrical antenna structure 800 of FIG. 8.

Figure 10F:
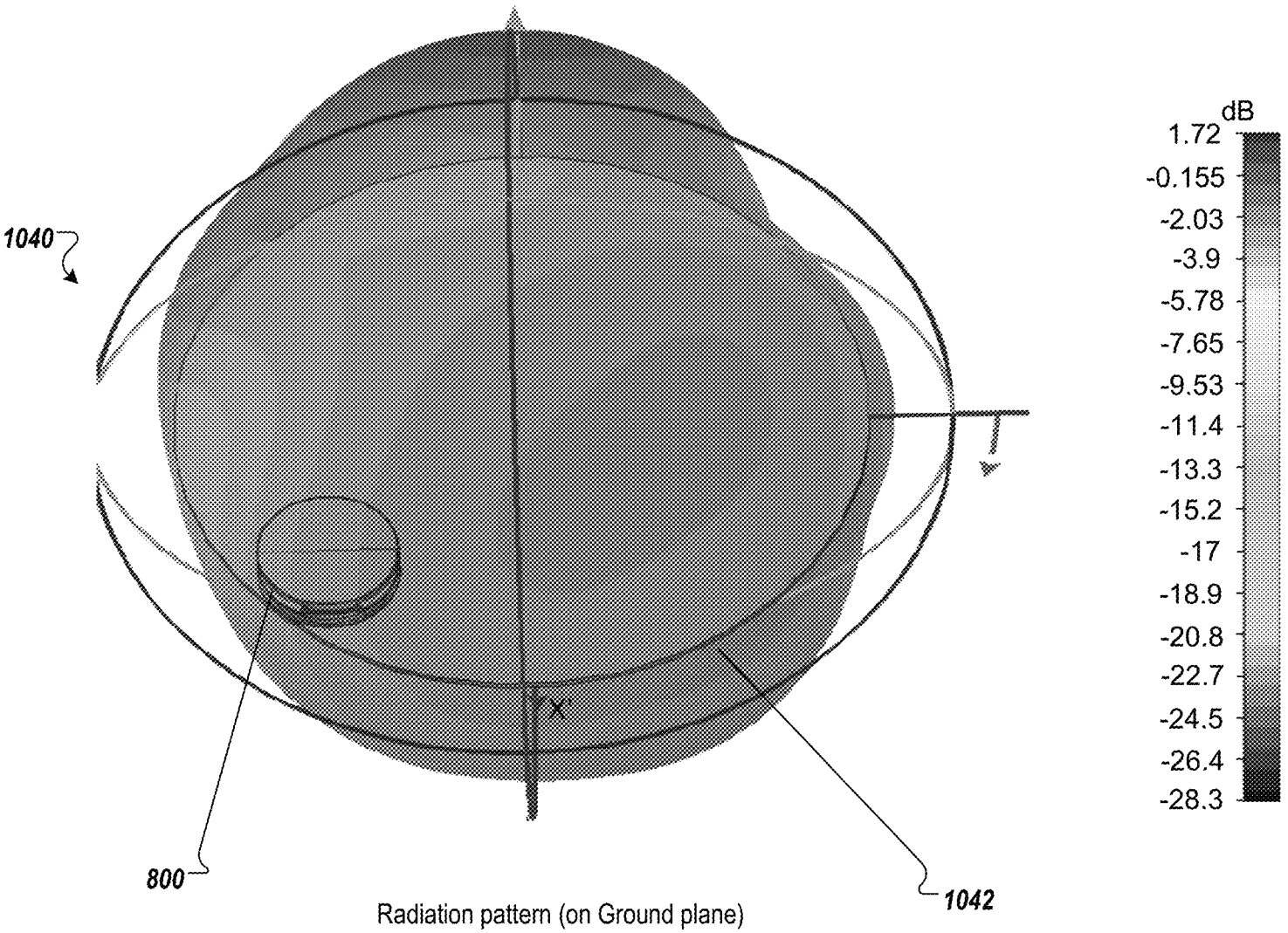
FIG. 10F is a perspective view of a spherical low gain radiation pattern when the low-profile cylindrical antenna structure of FIG. 8 is placed above a ground plane of a circuit board according to one embodiment.

The omnidirectional radiation pattern 1030 is in free space. However, in practice the cylindrical antenna structure 800 may be placed by surrounding objects, such as a ground plane, that distorts the radiation and reception pattern of the cylindrical antenna structure 800 as illustrated in FIG. 10F. FIG. 10F is a perspective view of a spherical low gain radiation pattern 1040 when the low-profile cylindrical antenna structure 800 of FIG. 8 is placed above a ground plane 1042 of a circuit board according to one embodiment. In free space, the cylindrical antenna structure 800, operating at 2.45 GHz, has a realized gain of 2.28 dB, with −1.062 dB radiation efficiency and −1.079 dB total efficiency with the omnidirectional radiation pattern 1030. The omnidirectional radiation pattern 1030 has the realized gain at the side edges of the radiation pattern in the horizontal plane. When disposed above the ground plane 1042, the cylindrical antenna structure 800, operating at 2.45 GHz, has a realized gain of 1.72 dB with the low gain spherical radiation pattern 1040. The spherical radiation pattern 1040 has the realized gain at the edges that are higher than the horizontal plane, as opposed to opposite sides in the omnidirectional radiation pattern 430.

Figure 11A:
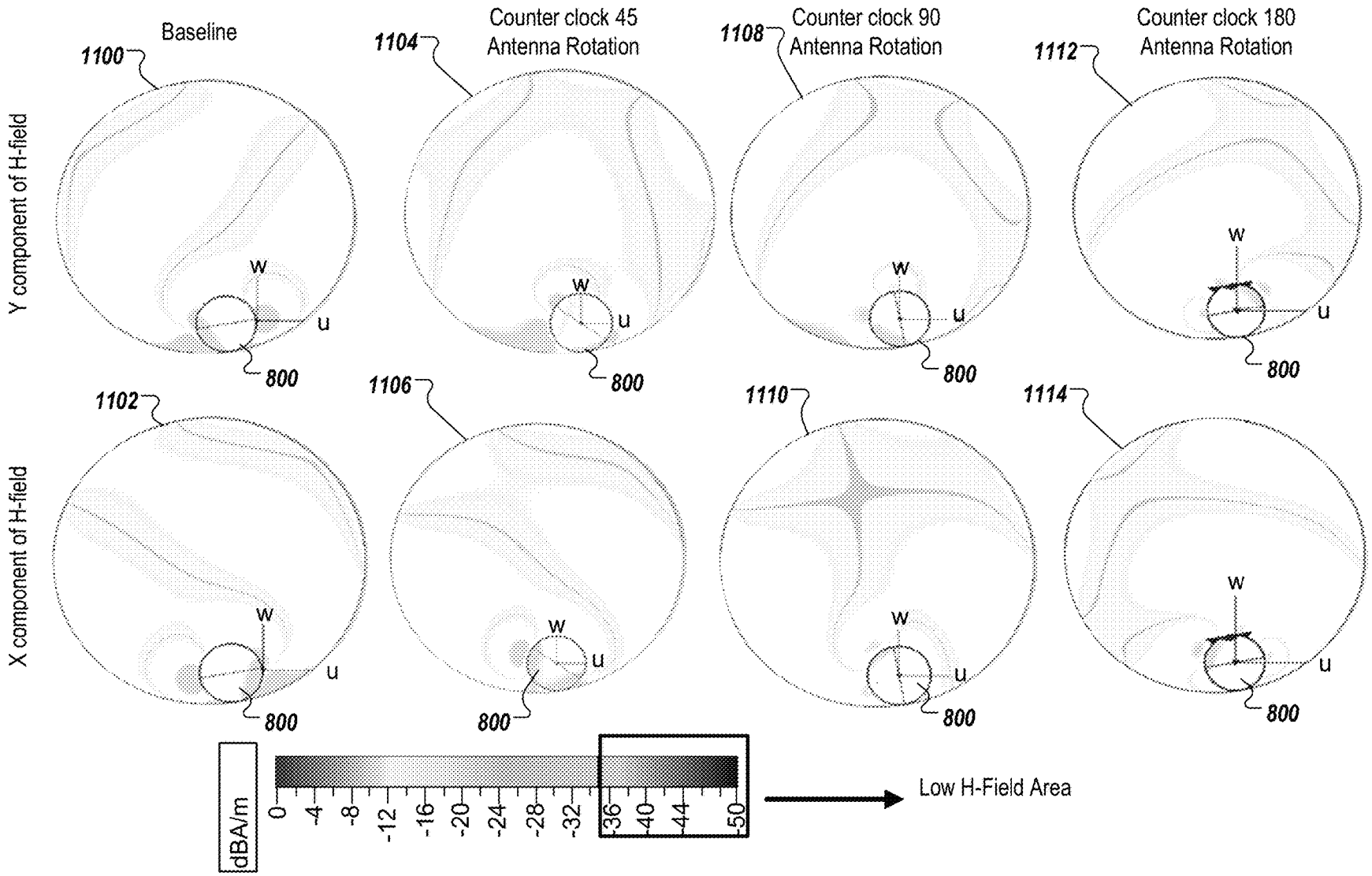
FIGS. 11A-11B illustrates X and Y components of the magnetic fields (H-fields) of the low-profile cylindrical antenna structure of FIG. 8 in various orientations but in the same location according to one embodiment.
Figure 11B:
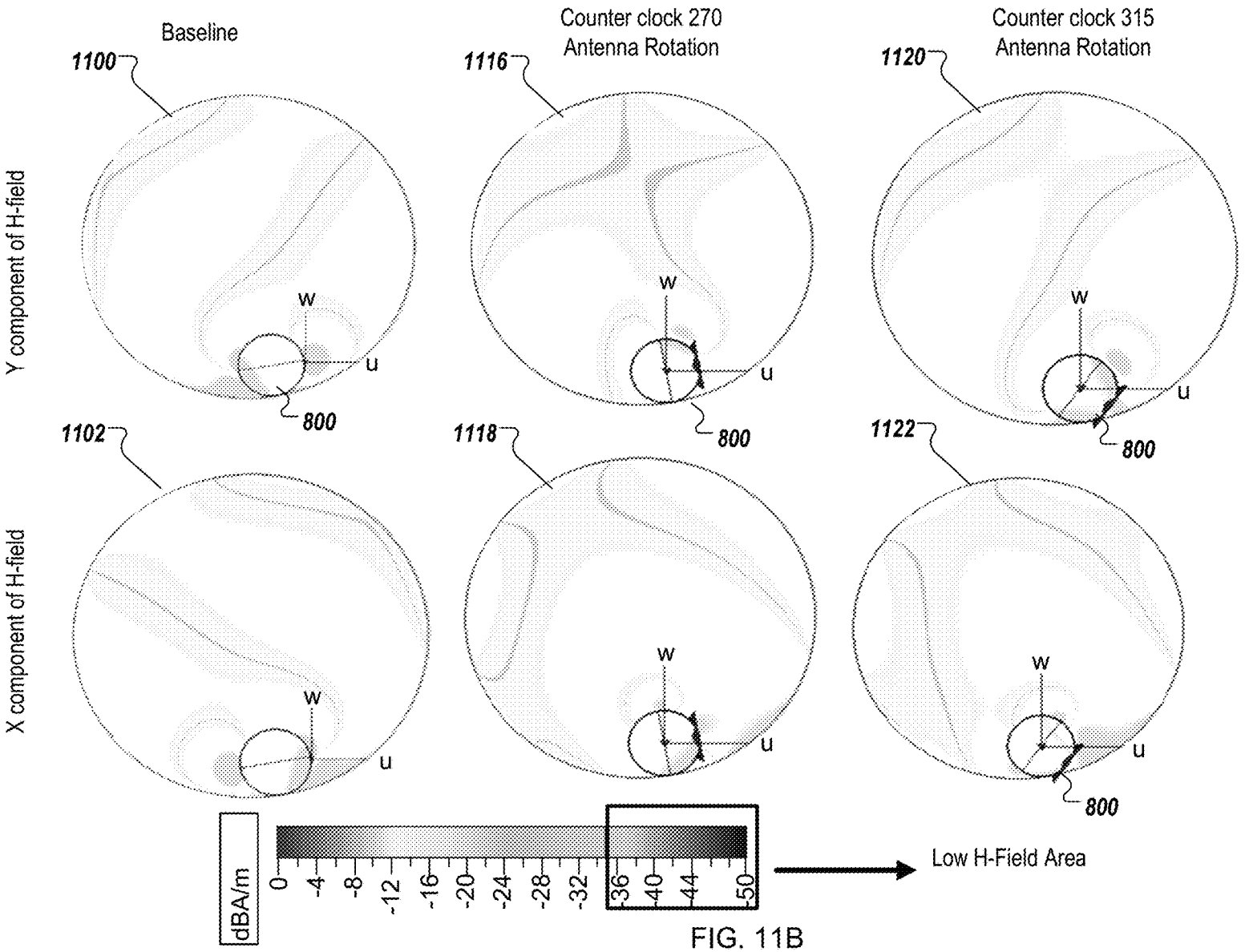

In some embodiments, the cylindrical antenna structure 800 can be considered a noise immune antenna since it can be tunable for low magnetic fields (H-fields) locations for suitable null locations to minimize desense from a noise source (also referred to as an aggressor). As illustrated in FIGS. 11A-11B, the magnetic fields (H-fields) can vary as the cylindrical antenna structure 800 is rotated in various orientations but in the same place rotated of antenna's own axis.

FIGS. 11A-11B illustrates X and Y components of the magnetic fields (H-fields) of the low-profile cylindrical antenna structure 800 of FIG. 8 in various orientations (rotated in its own axis) according to one embodiment. FIG. 11A illustrates the Y-component of the H-field 1100 and an X-component of the H-field 1102 at a baseline position. By rotating the cylindrical antenna structure 800 by 45 degrees, the Y-component of the H-field 1104 and the X-component of the H-field 1106 can also change. Similarly, FIG. 11A shows the Y-component of the H-field 1108 and an X-component of the H-field 1110 at a position that is rotated by 90 degrees from the baseline position. FIG. 11A shows the Y-component of the H-field 1112 and an X-component of the H-field 1114 at a position that is rotated by 180 degrees from the baseline position. FIG. 11B shows the Y-component of the H-field 1116 and an X-component of the H-field 1118 at a position that is rotated by 270 degrees from the baseline position. FIG. 11B shows the Y-component of the H-field 1120 and an X-component of the H-field 1122 at a position that is rotated by 315 degrees from the baseline position. Based on the orientation of the cylindrical antenna structure 800 of its own axis, regions of the circuit board can be at low H-fields of the cylindrical antenna structure 800. A low H-field can be −36 dBA/m or lower in these regions of the circuit board.

Figure 12:
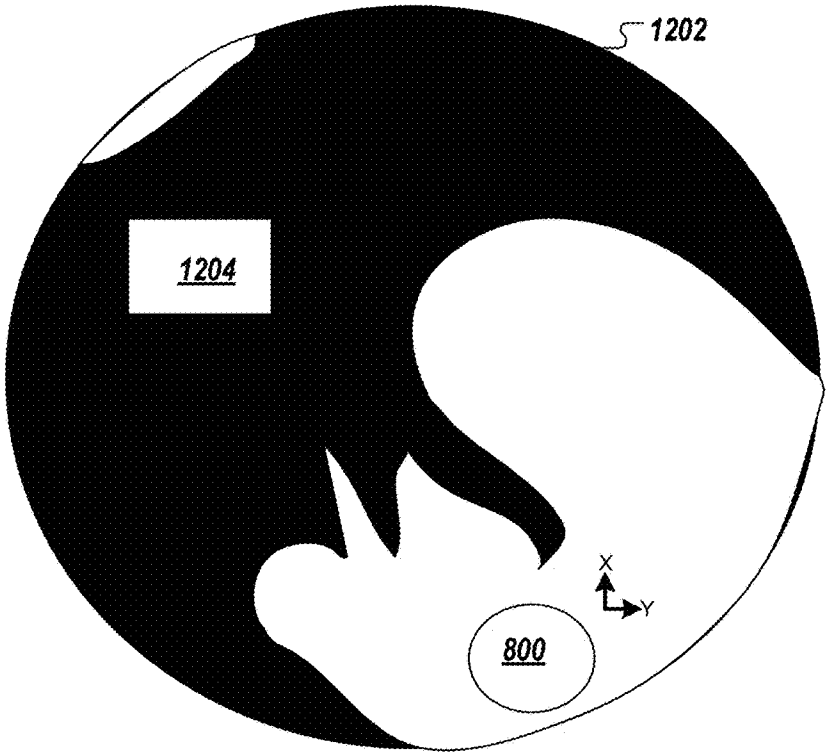
FIG. 12 illustrates composites low H-Field locations from the low H-field regions in the X and Y components in FIGS. 11A-11B according to one embodiment.
Figure 12:
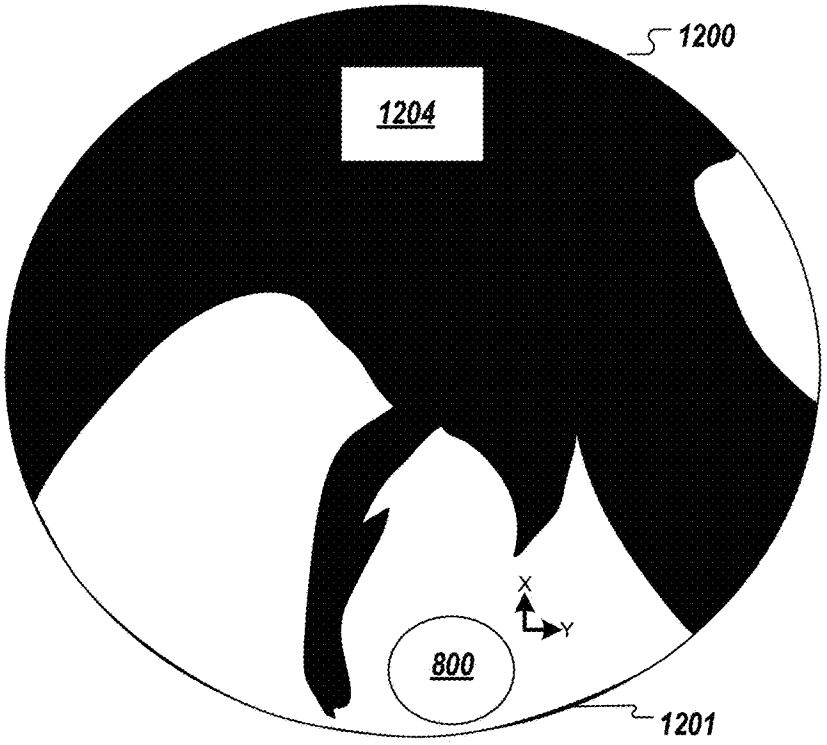

FIG. 12 illustrates composite field strengths of the locations from the low H-field regions in the X and Y components in FIGS. 11A-11B according to one embodiment. The cylindrical antenna structure 800 is placed in a first region 1201 with a first orientation. The cylindrical antenna structure on the ground plane 800 have a composite low field strength in the Y component in a region 1200 and a composite low field strength in the X component in a region 1202. The low Y H-Field region 1200 and the low X H-field region 1202 can be used to determine a location at which a noise component 1204 can be place without affect the cylindrical antenna structure 800. For example, a processor, a memory, a motor, or other noise sources can be located in the region 1200 or in the region 1202 based on their dominant noise influence, either X or Y dominant. Thus, the cylindrical antenna structure 800 can be treated as a noise-immune antenna.

In another embodiment, a wireless device can include a cylindrical antenna structure of metal. The cylindrical antenna structure can include a first surface, a second surface, and a side wall with a first height between the first surface and the second surface. The first height can be less than 20 mm. The side wall includes: a first slot that is centered at a first point on the side wall at a second height from the second surface and is oriented longitudinally along an azimuthal direction of the cylindrical antenna structure; and a second slot that is centered at a second point on the side wall at the second height and is oriented longitudinally along the azimuthal direction, the second point being diametrically opposite the first point about a center axis of the cylindrical antenna structure. The wireless device also includes a coupled feed structure having a metal member located on the center axis that is physically separated from the first surface and the second surface. The cylindrical antenna structure is configured to radiate electromagnetic energy in a low gain bi-directional radiation pattern, responsive to a RF signal being applied to the coupled feed structure.

In a further embodiment, the first surface, the second surface, and the side wall form a right circular, hollow cylinder. The side wall can include a third slot that is centered at a third point on the side wall at a third height from the second surface and is oriented longitudinally along the azimuthal direction. The side wall can include a fourth slot that is centered at a fourth point on the side wall at the third height and is oriented longitudinally along the azimuthal direction, the fourth point is diametrically opposite the third point about the center axis. In this embodiment, the first point is equidistant from the third point and the fourth point and the second point is equidistant from the third point and the fourth point. Also, in this embodiment, the radiation pattern is an omnidirectional radiation pattern.

In a further embodiment, an antenna carrier is disposed on an inner surface of the cylindrical antenna structure. The antenna carrier includes dielectric material. The dielectric material can include plastic or other dielectric material.

In one embodiment, the first height is equal to or less than 0.2 wavelength corresponding to an operating frequency range. The operating frequency range can be a frequency range corresponding to a WLAN frequency band, a PAN frequency band, a cellular frequency band, or the like. In another embodiment, the first height is approximately 0.07 wavelength corresponding to an operating frequency. In another embodiment, the first height is approximately 8.7 mm and the cylindrical antenna structure is configured to radiate the electromagnetic energy in a 2.4 GHz frequency band. These antennas can be placed away from the main circuit board and can be feed with a coax cable.

In another embodiment, an electronic device includes a circuit board with a ground plane. A radio disposed on the circuit board. A first cylindrical shell with a first thickness, a circumference, and a center axis perpendicular to the circumference is disposed on the circuit board. The first cylindrical shell is metal and has a total height in a range of approximately 0.07 wavelength to approximately 0.1 wavelength, the wavelength corresponding to a frequency range of the radio. The first cylindrical shell includes a first opening in the metal. The first opening can be a slot, a window, a cutout, or the like. The first opening is oriented in an azimuthal direction along the circumference, the first opening having a first length in the azimuthal direction and arranged at a first height along the center axis. A first metallic plate with a second thickness and the circumference, disposed on a first end of the first cylindrical shell. A second metallic plate with the second thickness and the circumference, disposed on a second end of the first cylindrical shell. A coupled feed structure, having a metal member located on the center axis that is physically separated from the first metallic plate and the second metallic plate, is disposed within the first cylindrical shell. The radio is configured to apply a RF signal to the coupled feed structure and the first cylindrical shell is configured to radiate electromagnetic energy, responsive to the RF signal being applied to the coupled feed structure.

In a further embodiment, the first cylindrical shell further includes a second opening in the metal, the second opening oriented in the azimuthal direction, and the second opening having the first length in the azimuthal direction. The first opening and the second opening are arranged equidistantly along the circumference at the first height along the center axis.

In another embodiment, the first cylindrical shell further includes a third opening and a fourth opening in the metal. The third opening is oriented in the azimuthal direction, the third opening having the first length in the azimuthal direction. The fourth opening is oriented in the azimuthal direction, the fourth opening having the first length in the azimuthal direction. The third opening and the fourth opening are arranged equidistantly along the circumference at a second height along the center axis. The third opening and the fourth opening are rotated about the center axis by an azimuthal angle with respect to the first opening and the second opening. In this embodiment, the multi-directional radiation pattern is an omnidirectional radiation pattern.

In another embodiment, the first opening in the metal includes: a first rectangular portion with a second length in the azimuthal direction and a first width perpendicular to the azimuthal direction; a second rectangular portion with the second length along in the azimuthal direction and the first width perpendicular to the azimuthal direction; and a third rectangular portion with a third length in the azimuthal direction and a second width perpendicular to the azimuthal direction. The second width is less than the first width and the third rectangular portion is located between the first rectangular portion and the second rectangular portion in the azimuthal direction. In other embodiments, each of the four openings is identical. In other embodiments, two of the four openings are identical and the other two of the four openings are identical. Alternatively, other shapes of openings can be used.

In another embodiment, a second cylindrical shell with a third thickness, a second circumference that is less than the circumference of the first cylindrical shell, and a second center axis is disposed within the first cylindrical cell. The second center axis is superimposed over the center axis. The second cylindrical shell is a dielectric material and has a second total height that is equal to or less than the total height of the first cylindrical shell. In some cases, the dielectric material includes plastic.

As described below in more detail with respect to FIGS. 11A-12, the cylindrical antenna variant in FIG. 8 can be considered a noise-immune antennas as other noise sources can be disposed in low H-regions of the cylindrical antenna structure. In one embodiment, a component, such as a noise-generating component (e.g., motor, processor or memory operating at high speeds, a bus, or the like, is disposed in a first region of the circuit board. The radio and the first cylindrical shell are disposed in a second region of the circuit board. In this embodiment, the low gain spherical radiation pattern has a peak gain of 1.72 dBi and a magnetic field (H-field) of approximately −36 dBA/m to approximately −50 dBA/m in the first region. But because it is in the first region where the H-fields are low, the antenna is noise immune from the noise generating component. In some cases, the component is configured to crate Electromagnetic interference (EMI) within the first region and not within the second region. The component can be a processor, a memory device, a motor, or the like. In some cases, the component does not need or does not use EMI shielding because the cylindrical antenna structure is noise immune as described herein.

In one embodiment, the radio is a WLAN radio that operates in a WLAN frequency band. In another embodiment, the radio is a PAN radio that operates in a PAN frequency band. In another embodiment, the radio is a cellular radio that operates in a cellular frequency band.

In one embodiment, the total height is approximately 8.7 mm and the first cylindrical shell is configured to radiate the electromagnetic energy in a 2.4 GHz frequency band.

In one embodiment, the first cylindrical metal shell has a circumference and an axis perpendicular to the circumference and is at least partially filled with a dielectric material. The first cylindrical metallic shell includes a first opening with a first length along the circumference and a first height along the axis and a second opening with the first length and the first height. The first opening and the second opening are arranged equidistantly along the circumference with the first length parallel to the circumference at a height along the axis. A second cylindrical shell is identical to the first cylindrical shell. The second cylindrical shell is rotated by an angle with respect to the first cylindrical shell and the second cylindrical shell is integral to the first cylindrical shell to form a single cylindrical shell. A first metallic plate with the circumference is disposed on a first end of the single cylindrical shell. A second metallic plate with the circumference is disposed on a second end of the single cylindrical shell. Each of the first opening and the second opening includes: a first rectangular portion with a second length along the circumference and a second height along the axis; a second rectangular portion with the second length along the circumference and the second height along the axis; and a third rectangular portion with a third length along the circumference and a third height along the axis. The third height is less than the second height and the third rectangular portion is located between the first rectangular portion and the second rectangular portion along the circumference. A coupled feed structure is disposed at a center of the single cylindrical shell along the axis to receive a signal.

In another embodiment, an electronic device includes a single-slot antenna structure with noise-immune regions on the circuit board. In one embodiment, the electronic device includes a circuit board having a ground plane, a radio disposed in a first region of the circuit board, and a first component disposed in a second region of the circuit board.

A cylindrical antenna structure of the metal is disposed on the circuit board. The cylindrical antenna structure is disposed in the first region. The cylindrical antenna structure includes a first surface, a second surface, and a side wall with a first height between the first surface and the second surface, the first height being less than 0.1 wavelength corresponding to a frequency range of the radio. The side wall includes a first slot that is centered at a first point on the side wall at a second height from the second surface and is oriented longitudinally along an azimuthal direction of the cylindrical antenna structure. A coupled feed structure has a metal member located on the center axis that is physically separated from the first surface and the second surface. The cylindrical antenna structure is configured to radiate electromagnetic energy in a radiation pattern, responsive to a RF signal being applied to the coupled feed structure. The radiation pattern at the ground plane has a peak gain of 1.72 dB/m and a magnetic field (H-field) of approximately −36 dB/m to approximately −50 dB/m in the second region.

Figure 13:
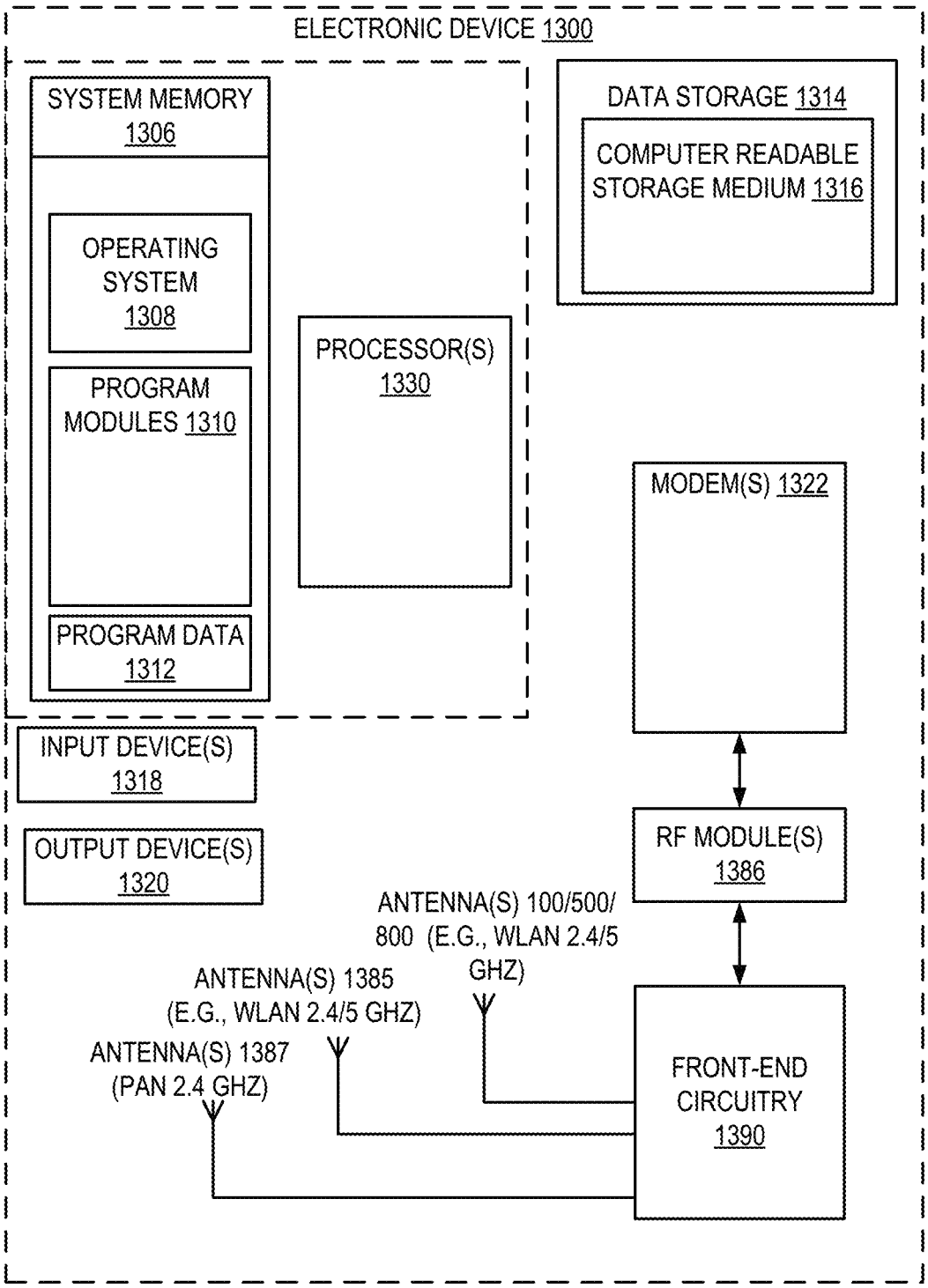
FIG. 13 is a block diagram of an electronic device that includes a low-profile cylindrical antenna structure as described herein according to one embodiment.

FIG. 13 is a block diagram of an electronic device that includes a low-profile cylindrical antenna structure 100/500/800 as described herein according to one embodiment. The electronic device 1300 may correspond to the electronic devices described above with respect to FIGS. 1-12. In one embodiment, the electronic device 1300 includes the cylindrical antenna structure 100 of FIG. 1. In another embodiment, the electronic device 1300 includes the cylindrical antenna structure 500 of FIG. 5. In another embodiment, the electronic device 1300 includes the cylindrical antenna structure 800 of FIG. 8. Alternatively, the electronic device 1300 may be other electronic devices, as described herein.

The electronic device 1300 includes one or more processor(s) 1330, such as one or more CPUs, microcontrollers, field programmable gate arrays, or other types of processors. The electronic device 1300 also includes system memory 1306, which may correspond to any combination of volatile and/or non-volatile storage mechanisms. The system memory 1306 stores information that provides operating system component 1308, various program modules 1310, program data 1312, and/or other components. In one embodiment, the system memory 1306 stores instructions of methods to control operation of the electronic device 1300. The electronic device 1300 performs functions by using the processor(s) 1330 to execute instructions provided by the system memory 1306.

The electronic device 1300 also includes a data storage device 1314 that may be composed of one or more types of removable storage and/or one or more types of non-removable storage. The data storage device 1314 includes a computer-readable storage medium 1316 on which is stored one or more sets of instructions embodying any of the methodologies or functions described herein. Instructions for the program modules 1310 may reside, completely or at least partially, within the computer-readable storage medium 1316, system memory 1306 and/or within the processor(s) 1330 during execution thereof by the electronic device 1300, the system memory 1306 and the processor(s) 1330 also constituting computer-readable media. The electronic device 1300 may also include one or more input devices 1318 (keyboard, mouse device, specialized selection keys, etc.) and one or more output devices 1320 (displays, printers, audio output mechanisms, etc.).

The electronic device 1300 further includes a modem 1322 to allow the electronic device 1300 to communicate via a wireless connections (e.g., such as provided by the wireless communication system) with other computing devices, such as remote computers, an item providing system, and so forth. The modem 1322 can be connected to one or more radio frequency (RF) modules 1386. The RF modules 1386 may be a WLAN module, a WAN module, wireless personal area network (WPAN) module, Global Positioning System (GPS) module, or the like. The antenna structures (antenna(s) 100/500/800, 1385, 1387) are coupled to the front-end circuitry 1390, which is coupled to the modem 1322. The front-end circuitry 1390 may include radio front-end circuitry, antenna switching circuitry, impedance matching circuitry, or the like. The antennas 100/500/800 may be GPS antennas, Near-Field Communication (NFC) antennas, other WAN antennas, WLAN or PAN antennas, or the like. The modem 1322 allows the electronic device 1300 to handle both voice and non-voice communications (such as communications for text messages, multimedia messages, media downloads, web browsing, etc.) with a wireless communication system. The modem 1322 may provide network connectivity using any type of mobile network technology including, for example, Cellular Digital Packet Data (CDPD), General Packet Radio Service (GPRS), EDGE, Universal Mobile Telecommunications System (UMTS), Single-Carrier Radio Transmission Technology (1×RTT), Evaluation Data Optimized (EVDO), High-Speed Down-Link Packet Access (HSDPA), Wi-Fi®, Long Term Evolution (LTE) and LTE Advanced (sometimes generally referred to as 4G), etc.

The modem 1322 may generate signals and send these signals to antenna(s) 100/500/800 of a first type (e.g., WLAN 5 GHz), antenna(s) 1385 of a second type (e.g., WLAN 2.4 GHz), and/or antenna(s) 1387 of a third type (e.g., WAN), via front-end circuitry 1390, and RF module(s) 1386 as descried herein. Antennas 100/500/800, 1385, 1387 may be configured to transmit in different frequency bands and/or using different wireless communication protocols. The antennas 100/500/800, 1385, 1387 may be directional, omnidirectional, spherical, or multi-directional antennas. In addition to sending data, antennas 100/500/800, 1385, 1387 may also receive data, which is sent to appropriate RF modules connected to the antennas. One of the antennas 100/500/800, 1385, 1387 may be any combination of the cylindrical antenna structures described herein.

In one embodiment, the electronic device 1300 establishes a first connection using a first wireless communication protocol, and a second connection using a different wireless communication protocol. The first wireless connection and second wireless connection may be active concurrently, for example, if an electronic device is receiving a media item from another electronic device via the first connection) and transferring a file to another electronic device (e.g., via the second connection) at the same time. Alternatively, the two connections may be active concurrently during wireless communications with multiple devices. In one embodiment, the first wireless connection is associated with a first resonant mode of an antenna structure that operates at a first frequency band and the second wireless connection is associated with a second resonant mode of the cylindrical antenna structure that operates at a second frequency band. In another embodiment, the first wireless connection is associated with a first antenna structure and the second wireless connection is associated with a second antenna.

Though a modem 1322 is shown to control transmission and reception via antenna (100/500/800, 1385, 1387), the electronic device 1300 may alternatively include multiple modems, each of which is configured to transmit/receive data via a different antenna and/or wireless transmission protocol.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to convey the substance of their work most effectively to others skilled in the art. An algorithm is used herein, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, Read-Only Memories (ROMs), compact disc ROMs (CD-ROMs) and magnetic-optical disks, Random Access Memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A wireless device comprising:

a radio; and a first cylindrical antenna structure of metal, the first cylindrical antenna structure comprising a top surface, a bottom surface, and a side wall with a first height between the top surface and the bottom surface, the first height being equal to or less than 0.1 times of a wavelength corresponding to an operating frequency range of the first cylindrical antenna structure, the operating frequency range being between approximately 2.4 GHz to approximately 2.485 GHz, wherein:

the top surface, the bottom surface, and the side wall form a hollow cylinder;

the side wall comprises a first slot that is centered at a first point on the side wall at a second height from the bottom surface and is oriented longitudinally along an azimuthal direction of the first cylindrical antenna structure;

the side wall comprises a second slot that is centered at a second point on the side wall at the second height and is oriented longitudinally along the azimuthal direction, the second point being diametrically opposite the first point;

the side wall comprises a third slot that is centered at a third point on the side wall at a third height from the bottom surface and is oriented longitudinally along the azimuthal direction, the third height being greater than the second height;

the side wall comprises a fourth slot that is centered at a fourth point on the side wall at the third height and is oriented longitudinally along the azimuthal direction, the fourth point being diametrically opposite the third point;

the first point is equidistant from the third point and the fourth point;

the second point is equidistant from the third point and the fourth point; and a feed structure coupled to the radio, the feed structure having a metal member located along a center axis of the first cylindrical antenna structure, the metal member being physically separated from the top surface and the bottom surface, wherein the radio applies a radio frequency (RF) signal to the feed structure and the first cylindrical antenna structure is configured to radiate electromagnetic energy in an omnidirectional radiation pattern.

2. The wireless device of claim 1, further comprising:

a second cylindrical structure of dielectric material located within the first cylindrical antenna structure and having a center axis that is the same as the center axis of the first cylindrical antenna structure, wherein:

an outer surface of the second cylindrical structure is adjacent to an inner surface of the first cylindrical antenna structure; and a thickness of the second cylindrical structure is less than a radius of the first cylindrical antenna structure.

3. An apparatus comprising:

a cylindrical antenna structure of metal, the cylindrical antenna structure comprising:

a first surface, a second surface, and a side wall with a first height between the first surface and the second surface, the first height being equal to or less than 0.1 times of a wavelength corresponding to an operating frequency range of the cylindrical antenna structure, the operating frequency range being between approximately 2.4 GHz to approximately 2.485 GHz, wherein the side wall comprises:

a first slot that is centered at a first point on the side wall at a second height from the second surface and is oriented longitudinally along an azimuthal direction of the cylindrical antenna structure; and a second slot that is centered at a second point on the side wall at the second height and is oriented longitudinally along the azimuthal direction, the second point being diametrically opposite the first point; and a metal feed structure coupled to the cylindrical antenna structure located along a center axis of the first cylindrical antenna structure, the metal feed structure being physically separated from the first surface and the second surface, wherein the cylindrical antenna structure is configured to radiate electromagnetic energy in at least a bi-directional radiation pattern, a spherical radiation pattern, or an omnidirectional radiation pattern, responsive to a radio frequency (RF) signal being applied to the metal feed structure.

4. The apparatus of claim 3, wherein the cylindrical antenna structure is hollow, and wherein:

the side wall further comprises a third slot that is centered at a third point on the side wall at a third height from the second surface and is oriented longitudinally along the azimuthal direction;

the side wall further comprises a fourth slot that is centered at a fourth point on the side wall at the third height and is oriented longitudinally along the azimuthal direction, the fourth point is diametrically opposite the third point;

the first point is equidistant from the third point and the fourth point; and the second point is equidistant from the third point and the fourth point.

5. The apparatus of claim 3, further comprising an antenna carrier disposed on an inner surface of the cylindrical antenna structure, wherein the antenna carrier comprises dielectric material.

6. The apparatus of claim 5, wherein the antenna carrier comprises: a second cylindrical structure of the dielectric material located within the cylindrical antenna structure and having a center axis that is the same as a center axis of the first cylindrical antenna structure, wherein:

an outer surface of the second cylindrical structure is adjacent to an inner surface of the first cylindrical antenna structure; and a thickness of the second cylindrical structure is less than a radius of the first cylindrical antenna structure.

7. The apparatus of claim 3, wherein the first height is equal to or less than 0.2 times of a wavelength corresponding to an operating frequency range of the radio.

8. The apparatus of claim 7, wherein the operating frequency range is at least one of a wireless local area network (WLAN) frequency band, a personal area network (PAN) frequency band, or a cellular frequency band.

9. The apparatus of claim 3, wherein the first height is approximately 0.07 times of a wavelength corresponding to a frequency range between approximately 2.4 GHz to approximately 2.485 GHz.

10. The apparatus of claim 3, wherein the first height is approximately 8.7 millimeter (mm), and wherein the cylindrical antenna structure is configured to radiate the electromagnetic energy in a 2.4 GHz frequency band.

11. An electronic device comprising:

a circuit board comprising a ground plane;

a radio disposed on the circuit board; and a first cylindrical shell with a first thickness, a circumference, and a center axis perpendicular to the circumference, the first cylindrical shell comprising:

a first opening in metal of the first cylindrical shell, the first opening oriented in an azimuthal direction along the circumference, the first opening having a first length in the azimuthal direction and arranged at a first height along the center axis, wherein:

the first opening in the metal comprises:

a first rectangular portion with a second length in the azimuthal direction and a first width perpendicular to the azimuthal direction;

a second rectangular portion with the second length along in the azimuthal direction and the first width perpendicular to the azimuthal direction; and a third rectangular portion with a third length in the azimuthal direction and a second width perpendicular to the azimuthal direction, the second width is less than the first width; and the third rectangular portion is located between the first rectangular portion and the second rectangular portion in the azimuthal direction; and a first metallic plate with a second thickness and the circumference, disposed on a first end of the first cylindrical shell;

a second metallic plate with the second thickness and the circumference, disposed on a second end of the first cylindrical shell; and a feed structure having a metal member located on the center axis that is physically separated from the first metallic plate and the second metallic plate, wherein the radio is configured to apply a radio frequency (RF) signal to the feed structure, wherein the first cylindrical shell is configured to radiate electromagnetic energy in a hemispherical radiation pattern, responsive to the RF signal being applied to the feed structure.

12. The electronic device of claim 11, wherein the first cylindrical shell further comprises a second opening in the metal, the second opening oriented in the azimuthal direction, the second opening having the first length in the azimuthal direction, wherein the first opening and the second opening are arranged equidistantly along the circumference at the first height along the center axis.

13. The electronic device of claim 12, wherein the first cylindrical shell further comprises:

a third opening in the metal, the third opening oriented in the azimuthal direction, the third opening having the first length in the azimuthal direction; and a fourth opening in the metal, the fourth opening oriented in the azimuthal direction, the fourth opening having the first length in the azimuthal direction, wherein:

the third opening and the fourth opening are arranged equidistantly along the circumference at a second height along the center axis; and the third opening and the fourth opening are rotated by an azimuthal angle with respect to the first opening and the second opening.

14. The electronic device of claim 11, further comprising: a second cylindrical shell with a third thickness, a second circumference that is less than the circumference of the first cylindrical shell, and a second center axis, the second cylindrical shell being disposed within the first cylindrical shell and the second center axis being superimposed over the center axis, wherein the second cylindrical shell is a dielectric material and has a second total height that is equal to or less than a total height of the first cylindrical shell.

15. The electronic device of claim 11, wherein the first height is approximately 0.07 times of a wavelength corresponding to a frequency range between approximately 2.4 GHz to approximately 2.485 GHz.

16. The electronic device of claim 11, further comprising: a component disposed in a first region of the circuit board, wherein the radio and the first cylindrical shell are disposed in a second region of the circuit board, wherein the hemispherical radiation pattern at the ground plane has a peak gain of 1.72 dBi and a magnetic field (H-field) of approximately −36 dBA/m to approximately −50 dBA/m in the first region.

17. The electronic device of claim 16, wherein the component is configured to create Electromagnetic interference (EMI) within the first region and not within the second region, and wherein the component is at least one of a processor, a memory device, or a motor, wherein the component does not comprise EMI shielding.

18. The electronic device of claim 11, wherein the radio is at least one of a wireless local area network (WLAN) radio that operates in a WLAN frequency band, a personal area network (PAN) radio that operates in a PAN frequency band, or a cellular radio that operates in a cellular frequency band.

19. The electronic device of claim 11, wherein a total height is approximately 8.7 millimeter (mm), and wherein the first cylindrical shell is configured to radiate the electromagnetic energy in a 2.4 GHz frequency band.

* * * * *